US008124184B2

(12) United States Patent
Sambasivan et al.

(10) Patent No.: US 8,124,184 B2
(45) Date of Patent: Feb. 28, 2012

(54) ALUMINUM PHOSPHATE COMPOUNDS, COMPOSITIONS, MATERIALS AND RELATED METAL COATINGS

(75) Inventors: Sankar Sambasivan, Chicago, IL (US); Kimberly A. Steiner, Chicago, IL (US)

(73) Assignee: Applied Thin Films, Inc., Evanston, IL (US)

( * ) Notice: Subject to any disclaimer, the term of this patent is extended or adjusted under 35 U.S.C. 154(b) by 0 days.

(21) Appl. No.: 12/724,052

(22) Filed: Mar. 15, 2010

(65) Prior Publication Data

US 2010/0183813 A1 Jul. 22, 2010

Related U.S. Application Data

(62) Division of application No. 10/627,194, filed on Jul. 24, 2003, now Pat. No. 7,678,465.

(60) Provisional application No. 60/398,265, filed on Jul. 24, 2002, provisional application No. 60/403,470, filed on Aug. 14, 2002.

(51) Int. Cl.
*B05D 3/00* (2006.01)

(52) U.S. Cl. ..... 427/327; 427/435; 427/331; 427/372.2

(58) Field of Classification Search ..... None
See application file for complete search history.

(56) References Cited

U.S. PATENT DOCUMENTS

| | | | | |
|---|---|---|---|---|
| 2,165,819 | A | | 7/1939 | Albers-Schonberg |
| 3,323,889 | A | | 6/1967 | Carl et al. |
| 3,450,574 | A | | 6/1969 | Reed |
| 3,516,811 | A | | 6/1970 | Gatchet et al. |
| 3,694,299 | A | | 9/1972 | Wagner |
| 3,711,322 | A | | 1/1973 | Kushihashi et al. |
| 3,793,105 | A | | 2/1974 | Birchall et al. |
| 3,839,078 | A | | 10/1974 | Birchall et al. |
| 3,847,583 | A | | 11/1974 | Dislich et al. |
| 3,870,737 | A | | 3/1975 | Birchall et al. |
| 3,926,103 | A | | 12/1975 | Smith |
| 3,943,231 | A | | 3/1976 | Wasel-Nielsen et al. |
| 3,960,592 | A | * | 6/1976 | Birchall et al. ..... 106/287.17 |
| 3,984,591 | A | | 10/1976 | Plumat et al. |
| 4,005,172 | A | | 1/1977 | Birchall et al. |
| 4,005,232 | A | | 1/1977 | Colebourne et al. |
| 4,008,299 | A | | 2/1977 | Birchall et al. |
| 4,289,863 | A | | 9/1981 | Hill et al. |
| 4,551,652 | A | | 11/1985 | Compen et al. |
| 4,929,493 | A | | 5/1990 | Tunker |
| 5,030,431 | A | | 7/1991 | Glemza |
| 5,146,743 | A | | 9/1992 | Maus et al. |
| 5,208,069 | A | | 5/1993 | Clark et al. |
| 5,223,336 | A | | 6/1993 | Griffith et al. |
| 5,292,701 | A | | 3/1994 | Glemza et al. |
| 5,348,694 | A | | 9/1994 | Goldberger |
| 5,411,711 | A | | 5/1995 | Swars |
| 5,496,529 | A | | 3/1996 | Fogel et al. |
| 5,552,361 | A | | 9/1996 | Rieser et al. |
| 5,665,463 | A | | 9/1997 | Morgan et al. |
| 5,698,758 | A | | 12/1997 | Rieser et al. |
| 5,707,442 | A | | 1/1998 | Fogel et al. |
| 5,744,777 | A | | 4/1998 | Bernecki et al. |
| 5,856,027 | A | | 1/1999 | Murphy |
| 6,022,513 | A | | 2/2000 | Pecoraro et al. |
| 6,036,762 | A | * | 3/2000 | Sambasivan ..... 106/287.18 |
| 6,140,410 | A | | 10/2000 | Kolouch |
| 6,162,498 | A | | 12/2000 | Mennig et al. |
| 6,221,955 | B1 | | 4/2001 | Mequanint et al. |
| 6,312,819 | B1 | | 11/2001 | Jia et al. |
| 6,379,746 | B1 | | 4/2002 | Birch et al. |
| 6,383,989 | B2 | | 5/2002 | Jia et al. |
| 6,403,164 | B1 | | 6/2002 | Jonschker et al. |
| 6,461,415 | B1 | | 10/2002 | Sambasivan et al. |
| 6,589,324 | B2 | | 7/2003 | Kamo et al. |
| 6,589,661 | B2 | | 7/2003 | Neely, Jr. et al. |
| 6,677,053 | B2 | | 1/2004 | Yamaji et al. |
| 2002/0054884 | A1 | | 5/2002 | Peetermans et al. |
| 2003/0049134 | A1 | | 3/2003 | Leighton et al. |
| 2004/0011245 | A1 | | 1/2004 | Sambasivan et al. |
| 2004/0138058 | A1 | | 7/2004 | Sambasivan et al. |
| 2005/0106384 | A1 | | 5/2005 | Sambasivan et al. |

FOREIGN PATENT DOCUMENTS

| | | | |
|---|---|---|---|
| DE | 2406411 | A * | 8/1974 |
| EP | 000302465 | | 2/1989 |
| EP | 0539342 | | 4/1993 |
| FR | 2156800 | | 1/1973 |
| FR | 2176469 | | 2/1973 |
| GB | 1192304 | | 5/1970 |
| GB | 1322722 | | 7/1973 |
| GB | 1322724 | | 7/1973 |
| GB | 1322726 | | 7/1973 |
| GB | 1396795 | | 6/1975 |
| GB | 1451145 | | 9/1976 |
| GB | 2021544 | | 12/1979 |
| JP | 53011200 | | 2/1978 |
| JP | 60233163 | | 11/1985 |
| JP | 401036774 | | 2/1989 |
| JP | 02142881 | | 5/1990 |

(Continued)

OTHER PUBLICATIONS

Daviéro, S; Avinens, C; Ibanez, A; Giuntini, JC; Philppot, E. Couches Minces Diélectriques de Phosphate d'Aluminum. J. Phys. III, Sep. 25, 1992, pp. 745-756. (English Abstract included.).

(Continued)

*Primary Examiner* — David Turocy
(74) *Attorney, Agent, or Firm* — Reinhart Boerner Van Deuren s.c.

(57) ABSTRACT

Aluminophosphate compounds, compositions and/or materials as can be used for substrate coatings.

16 Claims, 23 Drawing Sheets

FOREIGN PATENT DOCUMENTS

| | | |
|---|---|---|
| JP | 5229911 | 7/1993 |
| RU | 2148017 | 4/2000 |
| WO | 9821797 | 5/1998 |
| WO | 2001142881 | 6/2001 |
| WO | 0216263 | 2/2002 |

OTHER PUBLICATIONS

Rothon, RN. Novel, Low Curing Temperature, Glassy, Inorganic Coatings, Derived from Soluble Complexes of Aluminum and Other Metal Phosphates. Chemistry and Industry, Jun. 1, 1974, pp. 457-459.

Daviéro, S; Avinens, C; Ibanez, A; Giuntini, JC; Philppot, E. Dielectric Properties of Amorphous Aluminum Phosphate Thin Films. Journal of Non-Crystalline Solids 146, 1992, pp. 279-284.

Daviéro, S; Avinens, C; Ibanez, A; Giuntini, JC; Philppot, E. A Structural Study of Amorphous Aluminum Phosphate Thin Films by X-Ray Absorption Spectroscopy. Thin Solid Films, 2226, 1993, pp. 207-214.

Weber, C; Field, R; Höfer, HH. Characterization of Aluminum Phosphate Gel. Key Engineering Materials, vol. 150, 1998, pp. 199-208.

* cited by examiner (1)

(2)

a)

b)

a)

b)

a)

b)

ALUMINUM PHOSPHATE COMPOUNDS, COMPOSITIONS, MATERIALS AND RELATED METAL COATINGS

RELATED METAL COATINGS

This application is a divisional of and claims priority benefit from application Ser. No. 10/627,194 filed on Jul. 24, 2003 and issued as U.S. Pat. No. 7,678,465 on Mar. 16, 2010, which claimed priority from provisional application Ser. Nos. 60/398,265 filed Jul. 24, 2002 and 60/403,470 filed Aug. 14, 2002, each of which is incorporated herein by reference.

The United States government has certain rights to this invention pursuant to Grant Nos. F49620-00-C-0022 and F49620-01-C-0014 from AFOSR (Air Force Office of Scientific Research) and subcontract Grant No. DE-FG02-01ER83149, from DOE (Department of Energy) each to Applied Thin Films, Inc.

FIELD OF INVENTION

The present invention relates to the development of a new amorphous inorganic oxide material, which is microstructurally dense and useful in a number of applications where it can be used in powder, bulk, fiber, and as a thin film or a coating. This invention is also related to surface modification of metals and alloys via application of thin films for providing protection against wear or abrasion, corrosion, and oxidation, over a range of temperatures and harsh environments and for providing suitable high emissivity, non-wetting, and non-stick surfaces.

There are a number of prior art patents related to synthesis of aluminum phosphate materials primarily for use as a catalyst support including crystalline and amorphous forms. Most synthetic methods comprise of using a sol-gel technique with raw materials that include commonly available salts of aluminum and a variety of phosphorous sources including phosphoric acid, ammonium hydrogen phosphates, phosphorous acid, and others. Many of these methods yield highly porous and crystalline forms and few thermally stable amorphous compositions (U.S. Pat. No. 4,289,863, Hill et al.; U.S. Pat. Nos. 5,698,758 and 5,552,361, both Rieser et al.; U.S. Pat. No. 6,022,513, Pecoraro et al. U.S. Pat. No. 3,943,231, Wasel-Nielen et al.; U.S. Pat. No. 5,030,431, Glemza; U.S. Pat. No. 5,292,701, Glemza et al.; U.S. Pat. No. 5,496,529 and U.S. Pat. No. 5,707,442, both Fogel et al.). Two prior art patents do teach formation of amorphous aluminum phosphate compositions. However, the materials derived are highly porous which are desired for catalytic applications. U.S. Pat. No. 4,289,863, teaches a new method for synthesizing amorphous Al-rich AlPO4 compositions which are more thermally stable than Al-poor compositions which crystallize at much lower temperatures. U.S. Pat. No. 6,022,513, teaches a slightly modified method for making Al-rich compositions which yields a microstructurally different form of amorphous aluminophosphate material. However, both synthetic methods yield highly porous materials with surface areas over 90 to 300 square meters per gram with a macropore volume of at least 0.1 ccs per gram as shown in the Pecoraro patent (pores are said to be between 60 nm to 1000 nm in U.S. Pat. No. 5,698,758).

Much of the utility of such prior art amorphous materials is related to their use as thin films on metals & alloys, glass, and ceramic substrates. To facilitate this utility, a combination of additional attributes would be advantageous including a stable and low-cost precursor solution and an environmentally-friendly, cost-effective, and versatile coating process providing good adhesion with aforementioned substrates. There is a growing need for coatings on metal and alloy substrates to provide protection and to perform other surface-related functions. Most of the prior art methods require either special pretreatments or additional layers to improve adhesion particularly with metal and alloy substrates. The use of primers, including phosphating agents, is well known in the paint industry. Conversion coatings are well known in the art as pretreatment techniques to provide corrosion protection and promote adhesion with paints. In this process, metal or alloy surfaces are treated with acids or other chemical agents containing phosphates or chromates which react with metal components of substrates to form metal phosphate or chromate. However, these procedures are environmentally toxic and the protection is not adequate. Similar primer layers are used for applying adherent coatings on metals and alloys. However, this adds to the cost and imposes additional constraints for matching material properties within the multilayered coating systems. It would be highly desirable to develop a one-step coating process that achieves both good adhesion and provides a substantially pore-free amorphous inorganic layer for corrosion protection and other purposes.

Prior art teaches that phosphates are excellent primers to improve the adhesion on metal substrates. Several patents are based on using phosphate as functional groups for better adhesion to the metal surfaces. See for example U.S. Pat. No. 6,140,410. A phosphate monomer is selected to provide phosphate reactive groups in the main chain of the ultimate phosphated polyurethane resin to improve adhesion of the polyurethane resin to a metal by the formation of $P—O^{-}M^{2+}$ ionic bonds. See for example U.S. Pat. No. 6,221,955. Adhesion between a metal and a polymeric material is enhanced by contacting the metal surface with a non-phosphate adhesion-promoting composition prior to bonding the polymeric material to the metal surface U.S. Pat. No. 6,554,948.

Numerous studies have been conducted as regards the application of thin layers on steel surfaces by means of sol gel techniques. For example, stainless steel surfaces have been coated with zirconium dioxide layers to improve corrosion resistance. Borosilicate glass layers have also been studied. However, it was found that the refractory systems (high melting oxides such as $ZrO_2$) do not result in dense layers via said techniques and that the borosilicate glass layers could only be applied in layer thicknesses of significantly below 1 micron so that sufficient mechanical and chemical protection could not be secured. (Sol-gel coatings on metals by M. Guglielmi, Journal of sol-gel science and technology, 8, 443-449 (1997); Sol-gel methods for oxide coatings by L. F. Francis, Materials and Manufacturing Processes 12, 963-1015, 1997). It is desirable to use an amorphous dense coating that is thermally durable and stable to protect various substrates. The primary advantage of an amorphous coating is that, if developed by a suitable process, it can provide a hermetic seal over a substrate such that access of gas or liquids that can potentially corrode the substrate is avoided. Many methods have been developed to deposit uniform crystalline coatings that are substantially pore or crack-free. Crystalline coatings do not provide hermetic protection from gas or liquid exposures.

Silica-based amorphous coatings have been developed and a recent patent prescribes a unique way to deposit such coatings (U.S. Pat. No. 6,162,498). However, the coating is not durable under certain harsh conditions and are not thermally stable at elevated temperatures or do not serve adequately as a transparent coating on glass due to processing limitations. High temperature stable glassy or vitreous coatings have also been developed by initially coating substrates with a slurry of glass frits and subsequently treating the coated material to high enough temperatures to melt the glass frits and form the vitreous coating. Vitreous enamel coatings have been in existence for many decades with many different compositions. However, they are usually thick and are porous and deform at elevated temperatures. Although hermetic protection may be achieved with this process, the requirement of high temperature processing to melt the glass frits may degrade the substrate and if low melting glass compositions are selected, they may not be durable due to the presence of sodium.

U.S. Pat. No. 6,403,164 discloses a method to use organic-inorganic hybrid films to provide protection against corrosion and for other uses. Although the deposited films are dense and pore-free, they are not suitable for high temperature applications (above 300° C.) and are relatively soft due to presence of organic material in the films. Such films are not wear or abrasion-resistant.

Prior art coatings have also included amorphous aluminum phosphate on metals derived from various methods. British Pat. No. 1,451,145 discloses a method to form hydrated form of aluminum phosphate coatings on metals using a chemical solution method. Due to the low temperature curing methods and presence of water (hydrated form), such coatings are not hard and robust enough to withstand abrasion encountered in many applications and are not microstructurally dense in an inorganic form to provide adequate oxidation or corrosion protection.

British Pat. Nos. 1,322,722, 1,322,724, and 1,322,726, and published article entitled "Novel, low curing temperature, glassy, inorganic coatings, derived from soluble complexes of aluminum and other metal phosphates", (Chemistry and Industry, vol. 1, (1974) 457-459) disclose utilizing a soluble polymer complex comprising of aluminum phosphate with HCl and hydroxyl-organic ligand. Although dense amorphous aluminum phosphate films have been reported utilizing this method, there are several shortcomings which relate to their poor performance and make it impractical for commercial use. First, the films contain residual chlorine (minimum of one weight %) which is not desirable for many metals and alloys. Second, as the film cures, toxic HCl gas is released (complex contains one mole HCl for every mole of $AlPO_4$) which is a significant environmental concern. Third, the synthetic process is relatively complex involving isolation of the complex in crystalline form and then dissolving it in appropriate solvents making it difficult to implement in practical applications.

Inert and/or vacuum treatments are necessary to produce the precursor in the aforementioned prior art and, in addition, it is not clear whether the prepared precursor solution has sufficient shelf stability, or if the solution decomposes upon exposure to the ambient (a potential concern due to the presence of volatile organics, such as ethanol, present as a ligand). No specific examples were given related to deposition of films on metal substrates or their corresponding behavior in an oxidation or corrosion tests. Due to the highly acidic nature of the precursor solution, metal or alloy substrates may be subjected to significant corrosion from chloride attack during film development. In addition, due to the lower curing temperature, adhesion to substrates may not be sufficiently high to yield durable films. Although curing temperatures ranging from 200-500 C were suggested, most often curing temperatures below 200 C were used and no specific example of films cured at 500 C was provided and no microstructural information was given. In addition, the coatings were found to adhere to molten aluminum. However, aluminum phosphate, in pure crystalline or amorphous forms, is chemically compatible with molten aluminum and has been found to be non-wetting due to low surface energy. Based on the poor adhesion of the prior art coatings, it is suspected that the coating is not chemically durable (due to presence of chlorine or poor film coverage or poor high temperature properties) and that the surface energy is not sufficiently low such that its applicability for non-stick or non-wetting applications may not be exploited.

In the aforementioned prior art, in addition, silicon and boron additions were needed to extend the amorphous nature of the material. Even with these additions, sufficient crystalline content (tridymite and cristobalite) was present after annealing the powder materials to 1090° C. for 3 hours. As explained below, for the present invention, substantial amounts of non-crystalline content with only the presence of tridymite phase were found for materials with varying Al/P stoichiometry after heat treatment at much higher temperatures and extended time periods. It is not uncommon that amorphous materials produced using various techniques may have distinct structural or network moieties such that their atom diffusivities and high temperature behavior may vary significantly. It appears that the network structure of the material derived under the aforementioned patent does not provide for a robust microstructure and may not be suitable for use especially at elevated temperatures.

Thus, the material produced in prior-art methods is not microstructurally dense or robust enough to provide the desired protection. In addition, none of the prior art methods provide a suitable process or precursor solution that is economical, stable and clear, and can be applied using a variety of well-known techniques such as dip, spray, brush, and flow. Furthermore, none of the processes associated with prior art methods offer the ability to provide good adhesion with substrates that is critically important for most applications. The prior art coatings are either not durable under certain atmospheric conditions or under certain harsh industrial or use environments where materials are subjected to thermal treatments or exposed to corrosive environments. Prior art inorganic coatings are also not completely transparent for use on glass where transmission properties are affected or other substrates where aesthetic property of the substrate (metallic appearance) needs to be preserved.

As a related consideration in the art, high strength metals such as zirconium and zirconium alloys, titanium and titanium alloys, alloyed steels and others become brittle when exposed to elementary hydrogen. This embrittlement is known to be associated with the penetration of hydrogen atoms into the metal lattice and has been the subject of extensive research. In spite of the considerable efforts to understand and thus combat hydrogen embrittlement, this phenomenon is still a major cause of failure of vital equipment such as heat transfer piping in nuclear power plants made of zirconium alloys, supersonic aircraft segments made of titanium alloys and machine parts such as bolts and shafts made of alloyed steels.

Efforts have been made in the past to overcome this catastrophic phenomenon by the use of coatings as diffusion barriers which has largely failed due to the extremely high permeability of hydrogen through most coating materials. Palladium coatings might be theoretically considered in view of its excellent properties and reasonable surface hardness, but commercially attractive processes for applying palladium films require high plating rates. But such plating rates often lead to undesirable film properties. In many such processes the palladium film is found to be brittle and susceptible to cracking. In addition, the process is expensive and produces environmentally toxic byproducts Metals whose position in the voltage series means that they react with water are susceptible to corrosion and require a protective coating that prevents attack by water and/or oxygen. For this purpose, the prior art includes a very wide variety of processes which have not yielded good results. Anodizing of aluminum (Eloxal process) is well known method to form protective alumina films, but the process does not yield pin-hole free alumina films and the associated electrolytic process limits its applicability and also produces environmentally toxic materials.

As evident from the preceding, a microstructurally dense form of amorphous aluminophosphate would be very useful for a number of applications. The prior art materials, for example, will not provide adequate protection to substrates from corrosion or oxidation at elevated temperatures. Porosity is not desired in their use in fiber form for use as reinforcement for composites or in optical applications. For photonic or laser applications, aluminum phosphate is desired as a glass host material. Erbium-doped phosphate glasses are being developed for use as fiber or planar waveguide amplifiers wherein a dense material is required to transmit light without any loss to scattering.

OBJECTS OF THE INVENTION

Figure 1:
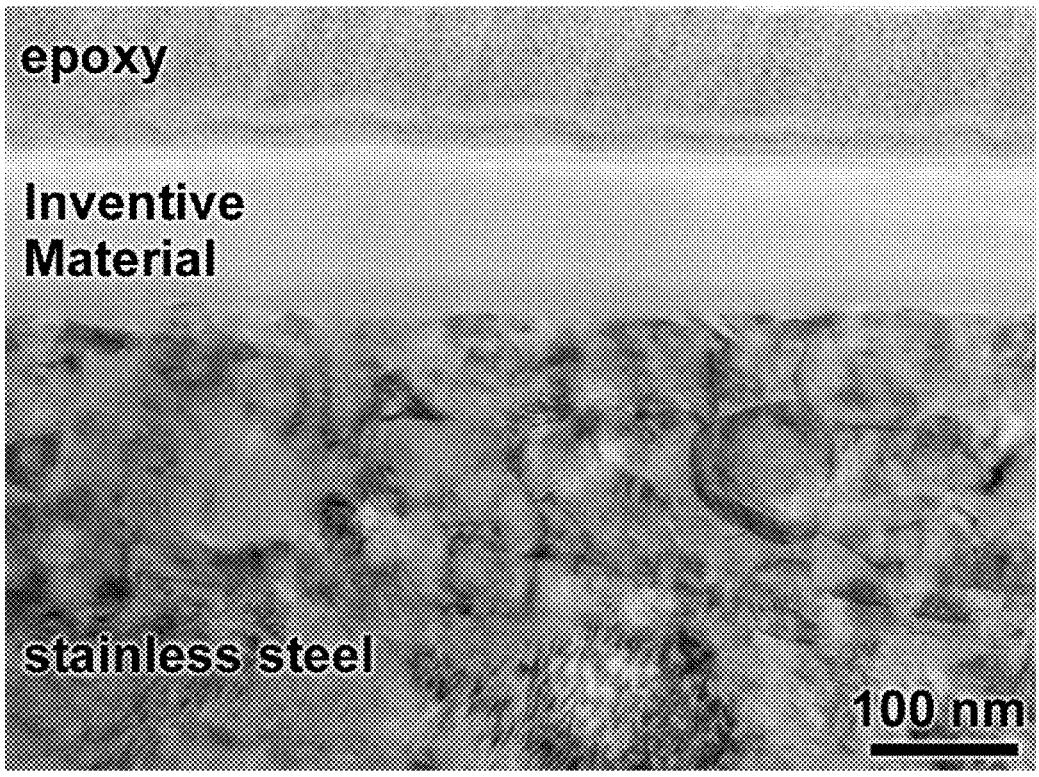
FIG. 1. Cross-sectional TEM micrograph showing a well-adherent, thin, uniform, dense and hermetic film of an inventive compound, composition and/or material on AUS 304 stainless steel.

In light of all the shortcomings of prior art discussed above, there is a need for a stable and microstructurally dense form of aluminophosphate which is chemically durable and thermally stable for use in a broad range of applications. Accordingly, it is an object of this invention to provide an amorphous aluminophosphate compound, composition and/or material for protective, functional, and multifunctional substrate coatings. Thus, there is a need to develop a durable glassy coating that is dense, smooth, continuous, hermetic or substantially pore-free, and transparent which can be deposited on a variety of substrates with excellent adhesion and at low cost with a simple environmentally friendly process. Most of the current and emerging applications utilizing metal/alloy substrates will require coatings that are multifunctional such that other properties along with corrosion protection can be induced. For example, antibacterial coatings are desired to limit the spread of bacteria and diseases for metal substrates. It would be desirable to develop a coating that provides both corrosion and antibacterial protection. Thus, a thermally stable and robust glassy coating material need be developed with an associated precursor system that can be flexible to induce multifunctional properties, and is practical for use in industry and commercial applications, that also offer low cost, simplicity, and environmental compliance.

It will be understood by those skilled in the art that one or more aspects of this invention can meet certain objectives, while one or more other aspects can meet certain other objectives. Each objective may not apply equally, in all its respects, to every aspect of this invention. As such, the following objects can be viewed in the alternative with respect to any one aspect of this invention.

It is a further object of the present invention to develop a (preferably transparent) glassy coating system which provides effective corrosion protection for a very wide variety of metallic substrates, preferably in combination with abrasion resistance properties.

In accordance with the invention it has been found that this object may be achieved by depositing an alumino-phosphate coating on the metal. Owing to the inorganic network, the resultant coatings also possess abrasion resistance properties, which may be strengthened further by incorporating nanoscale particles. Nanoparticles encompass dimensions ranging from about 1 nm to about 500 nm. Another effect of incorporating the nanosized particles is that such coatings remain transparent. The present invention accordingly provides a process for protecting a metallic substrate against corrosion by forming an inorganic glassy oxide film.

According to the present invention it has now been found that by using specific precursors, vitreous layers can be formed on metallic surfaces, which layers may be dimensioned less than about 10 microns. Surprisingly it has also been found that such layers can be converted into dense aluminum-phosphate films (for example on stainless steel or steel surfaces). Such films are about a few nanometers to about a few microns in thickness and form a hermetically sealing layer which prevents or drastically reduces, respectively, the access of oxygen to the metallic surface and secures an excellent protection against corrosion even at elevated temperatures. Such layers are furthermore abrasion-resistant. Furthermore such coatings are flexible, i.e., bending or folding the surface does not result in any cracks or other deterioration of the layers.

Another objective of the present invention is to develop a stable and microstructurally dense form of aluminophosphate material for use in the aforementioned applications. A further objective of the invention is to develop a low-cost, simple, and versatile chemical-solution based method to develop the amorphous material in the form of powder, coating, fiber, and bulk materials.

A yet another objective of the invention is to prepare a suitable clear precursor solution that yields high quality dense coatings of amorphous aluminophosphate. A further objective is to develop suitable precursor solutions such that other additives can be added to the solution such that new amorphous aluminophosphate compositions can be made. The additives can be added in a chemical form such that the solution is clear or the additives can be added in colloidal or powder form to yield a slurry-based solution. In any of the precursor forms used, a cured material obtained may be in the form of a nanocomposite (nanoparticles, nanocrystals or crystals embedded or encapsulated in the amorphous aluminophosphate matrix) or exist as uniformly-dispersed dopants within the glass matrix. In any of these forms, the additives, either individually or in conjunction with the aluminophosphate matrix can induce specific functionality useful for many applications. Such "mixed" aluminophosphate compositions can be formed as a powder or a coating or a fiber or as a bulk material. It is another object of the invention to develop films of the inventive compounds, compositions and/or materials with inclusions within the amorphous matrix material for inducing various functions including, but not limited to, optical, chemical, catalytic, physical, mechanical, and electrical properties. Such inclusions can be produced in-situ during the synthetic process and they may include metals, non-metals, and compounds of any combination of elements. One such example includes formation of carbon as nanosized inclusions for providing high emissivity and enhances mechanical properties. High emissivity coatings that are durable at elevated temperatures are desirable for a number of applications where thermal protection is desired or such coatings provide energy savings through re-radiating incident heat fluxes in furnaces, ducts, boilers, heat exchangers, and the like.

It is an object of the present invention to provide a material having as a feature of its molecular structure, an O═P—O—Al—O—Al bonding sequence (with organic and other ligands as may be attached to P and Al) regardless of P/Al ratio and any additional metal therein to enhance coating properties or to create nanocrystals that induce or enhance chemical, physical, optical, electrical, mechanical, and thermal properties (nanocomposite coatings).

It is an object of the present invention to provide surface modification of metals or alloys with a material coating to provide corrosion or oxidation resistance and/or to induce non-stick properties over a range of temperatures and environments; proven effective with stainless steel, aluminum alloys, nickel-based superalloys, Inconel, and other steel alloys.

It is an object of the present invention to provide such a material to develop coatings from about 0.05 micron to about 10 microns (preferably about 100 nm, more preferably about 500 nm, most preferably about 1 micron); the coatings are dense, continuous, smooth, uniform, and transparent. The inventive compounds, compositions and/or materials and/or related coatings are hermetic; that is, without open porosity or pathway fluid or gaseous ingression, and/or micro-structurally dense; that is, substantially non-porous and/or approaching zero pore volume. It is yet another object of the invention to develop thin films in the range of about 50 nm-about 10 microns that are transparent or opaque as desired for any application. It is yet another object of the invention to enable the use of these thin films for applications that require maintenance of strict design tolerances such that substrate geometry or features do not need to be modified to accommodate the thickness of the films deposited for protection or for other purposes of surface modification. With films of the inventive compounds, compositions and/or materials, as thin as about one micron or less, being sufficiently effective, no substrate modifications are necessary for most applications.

It is an object of the present invention to provide cured coatings using furnace or heat or infrared lamp or UV radiation (preferably @ 800 C, more preferably @ 600 C, and most preferably @ 500 C); UV radiation along with heat may cure the coating @ 250 C. It is a related object of the present invention to provide a curing process for excellent adhesion of the coating material.

It is an object of the present invention to provide coatings deposited using a dip or spray or flow or brush painting process. It is a further object of the invention to develop a process that utilizes a clear precursor solution that is stable (does not hydrolyze or decompose when exposed to ambient) and should enable versatile deposition processes including dip, spray, flow, and brush methods.

It is an object of the present invention to provide a material that functions as a protective coating in the short term, however, over long exposures at elevated temperatures, promotes the formation of a protective oxide scale thereunder that enhances the protection of substrates in the long term, as can be achieved via a low partial pressure of oxygen at the metal/coating interface during early stages, such that only stable oxides are formed underneath. For instance, stainless steel AUS304 where, in preference to a porous iron or manganese oxide, a dense chromium-rich oxide is formed; note that higher chrome steels are preferred for this reason, but with the material of this invention, even low Cr-containing steels will remain oxidation-resistant due to the promotion of Cr-rich oxide scales; proof of this was obtained with x-ray diffraction and elemental profiles across the scales. The same phenomenon occurs with nickel-based superalloys where alumina scale is preferentially formed during early stages of oxidation; an order of magnitude difference in oxidation rate is realized due to the presence of these coatings. This also allows the use of less-expensive alloys to be selected for certain applications and the alloy composition can be tailored to promote other properties (and not oxidation resistance), such as fatigue resistance, thermal conductivity, thermal expansion, electrical properties.

It is an object of the present invention to provide for thermal barrier coating (TBC) applications; growth of alumina scale between the bondcoat and ceramic coating leads to premature failure of the TBCs. The present coatings can be deposited on MCrAlY type bondcoats and then TBC deposited (preferably by e-beam PVD), whereby the growth of alumina scale during service is limited which will prevent catastrophic failure of TBCs due to spallation; proof of principle already demonstrated with deposition of the inventive compounds, compositions and/or materials on bondcoat showing reduced weight gain from oxidation above 1100 C.

It is an object of the present invention to provide material coatings sufficiently smooth to impart a low-friction surface (friction coefficients below 0.1 were measured on coatings on steel alloys). This allows for use of the material as a high temperature solid lubricant or as a wear resistant coating over a range of temperatures and environments; in this case, the inventive compounds, compositions and/or materials may serve as a multifunctional protective coating (nanocrystals within the material coating can be added to improve wear resistance or tailor thermal properties). It is yet another object of the invention to reduce the surface roughness of said substrates which is desired for many applications. The smooth nature of the films of the inventive compounds, compositions and/or materials deposited allows for planarization of most substrates. This will help in enhancing the non-wetting or non-stick nature of surfaces and also induces a low-friction surface with the added benefit of a lower surface energy attributed to the stable oxide surface on a metal/alloy substrate. It is a related object of the present invention to provide, due to the hermetic nature of the coating, protection of any metal/alloy from atmospheric corrosion.

It is an object of the present invention to provide protection of metal and alloy surfaces that contain defects which causes "accelerated corrosion". Access to moisture at these locations results in such behavior; upon oxidation at elevated temperatures, after a period of time, micron-sized defects on surfaces are enlarged to pits that are over 100 microns wide which eventually coalesce on the surface leading to "breakaway" oxidation. The inventive compounds, compositions and/or materials conformally cover these defects and eliminates accelerated corrosion. Because of this problem, metals and alloys are subjected to extensive surface preparation (which results in labor and material costs and generates waste) which can be reduced or eliminated with the use of such coatings.

It is an object of the present invention to provide, due to the non-stick properties, material coatings on metals and alloys that can be used in a number of applications where moving parts are used. Metal shafts, etc. are moved back and forth during service and if there is any debris that sticks to the surface, the motion is affected and eventually leads to failure of the part. The inventive compounds, compositions and/or materials coatings will help in not allowing unwanted debris from sticking to these parts and its smooth nature should improve the sliding characteristics; it may also serve to act as a dielectric or insulation coating for certain applications.

It is an object of the present invention to provide a non-stick and protective material highly suitable for use in the petroleum industry where corrosive and high temperature environments are experienced. Deposition of coke in ethylene cracking tubes is a major problem and the decoking process is expensive and is time-consuming The inventive compounds, compositions and/or materials coatings can be deposited on top of alloy coatings to avoid coke deposition.

It is an object of the present invention to provide protective coatings for molten material processing; the amorphous, dense, and non-stick nature of the present material is highly suitable for providing a non-stick surface. It can be used as a durable mold-release agent in die-casting. Most of the current mold-release agents used in aluminum and other metal casting processes are polymer-based which is durable only for one casting cycle. The durability and hardness of inventive compounds, compositions and/or materials coatings will help make it durable over several cycles which will save time and costs (proven to be an effective non-wetting protective coating for molten aluminum processing with the present coated products lasting twice as long as other coated products. The inventive compounds, compositions and/or materials can also be deposited on top of enamel coatings to seal the highly porous structure). The present invention protects against other molten materials as well as molten aluminum, including molten polymers, molten glass and other non-ferrous molten metals.

It is an object of the present invention to provide electrical insulation for many metal and alloy parts used in a wide range of industries. In some cases, both electrical insulation and corrosion resistance is required. The inventive compounds, compositions and/or materials can serve as a suitable dielectric for a number of applications; the pin-hole free nature of the coating is very attractive for this purpose Dielectric coatings are desired for example on flexible solar cell metal substrates (next generation need). The stability of metals and alloys used in plasma environments in the semiconductor or thin film processing equipment is a major concern. Coatings can be deposited on these metals and alloys to offer that protection. Additionally, it is an object of the invention to provide low dielectric constant films for semiconductors and thermally stable low observable coatings for defense applications.

It is an object of the present invention to provide an anti-tarnishing protective coating on metals and alloys. Polymer products are used to deposit a protective coating on these parts (door knobs, etc.), but they are not durable. The inventive compounds, compositions and/or materials are durable and can be transparent such that appearance is not affected.

It is an object of the present invention to protect metallic alloys against hydrogen embrittlement.

It is an object of the present invention to protect metals and alloys from corrosion and oxidation under thermal cycling conditions while the coating remains adherent to the substrate.

It is an objective of the invention that such coatings can be deposited on substrates including, but not limited to, glass, metal, alloy, ceramic, and polymers/plastics. It is a further objective of the invention to develop coating materials that are highly stable and possess low oxygen diffusivity such that ultra-thin films of the material will provide adequate protection to substrates. This will be a significant advantage over prior art coating materials where thick, non-hermetic coatings are used which crack or spall-off during thermal cycling causing catastrophic failure of the part during use. This is especially a concern in aerospace and energy applications where extremely high temperatures are used. It is yet another objective of the invention to allow the use of such coatings over a range of temperatures (cryogenic low temperatures to above about 140 C) in a broad range of benign to harsh environments. It is yet a further objective of the invention to utilize the low surface energy of the aluminophosphate material advantageously in applications where non-wetting or non-stick properties are desired. These may include, but not limited to, non-wetting against water, solvents, chemicals, solids, molten salts, molten metal, and atmospheric contaminants (including organic matter).

It is an object of the invention to protect metal and alloy substrates in both oxidizing and reducing environments. Metals and alloys are used in variety of environments that include gases, liquids, and solids in contact over a range of temperatures. For examples, hydrogen or gases that induce a reducing environment can react with metals and alloys to form undesirable reaction products or hydrogen can diffuse into the material which causes the well-known phenomenon of hydrogen embattlement. Fuel cells, for example, operate in a combination of oxidizing and reducing environments and materials used in their construction should be able to withstand the varying conditions. An inventive compound, composition and/or material, used as a thin film, can provide the necessary protection to various materials of construction used in many of these applications requiring harsh environments, especially at elevated temperatures. Molten materials, including but not limited to, metal sulfates (sodium sulfate, for example), metal vanadates, molten polymers (hot melt adhesives), molten metal (aluminum, zinc), are used or are present in a broad range of industrial processing environments that degrade metal/alloy components during service. The inventive compounds, compositions and/or materials, in thin film form, can provide excellent protection due to its thermal stability and demonstrated durability with these corrosive materials. Due to its robust nature (low atom diffusivity), films as thin as 100 nm are sufficient to provide the desired protection. The ability to use such thin films are particularly useful as they do not crack or spall upon thermal cycling. In addition, they protect the underlying substrate from oxidation or corrosion which further helps in preventing delamination of the deposited film of the inventive compounds, compositions and/or materials.

It is yet another objective of the invention to enable self-absorption of organic on the surface of the films of the inventive compounds, compositions and/or materials deposited on substrates. Due to the presence of certain organic contaminants in the atmosphere, surfaces of the inventive compounds, compositions and/or materials react with such organic materials, under ambient conditions, forming a stable bond with the organic material or its modified form via a self-absorption process. Such organic films further lower the surface energy of the composite structure, thus providing a hydrophobic or non-wetting surface. Organic films can also be deposited over the film of the inventive compounds, compositions and/or materials including, but not limited to, oleic acid and organosilanes, using simple dip-coating process. The organic layer present is characterized by observation of an organic group on the surface using Fourier transform infra-red spectroscopy (absorption bands at 2994, 2935, 1702, 1396, 1337 and 972 $cm^{-1}$ are observed which is attributed to an organic group attached to the surface of the inventive compounds, compositions and/or materials).

Organic layers can be deposited on the surface of the inventive compounds, compositions and/or materials to promote hydrophilic behavior such that bonding with certain materials are promoted. For example, adhesion of polymers to metals and alloys is poor. The use of the surface of the inventive compounds, compositions and/or materials, as an adhesive and corrosion-resistant interlayer on metals to bond with various polymers and ceramics will provide enhanced adhesion. Although the oxide nature of the surface of the inventive compounds, compositions and/or materials itself can promote direct adhesion with polymers, the adhesion characteristics can be further enhanced by deposition of suitable hydrophilic organic layers on top of the film prior to bonding with polymers or other materials. Thus the surface of the inventive compounds, compositions and/or materials can be tailored with organics to impart a hydrophobic or a hydrophilic character.

Other objects, features, benefits, and advantages of the present invention will be apparent from the preceding, the summary of this invention, and the following descriptions of various embodiments thereof, and will be readily apparent to those skilled in the art having knowledge of various coatings, protected substrates and/or composites. Such objects, features, benefits, and advantages will be apparent form the above as taken into conjunction with the accompanying examples, data, figures and all reasonable inferences to be drawn therefrom, alone or with consideration of the references incorporated herein.

SUMMARY OF INVENTION

It was surprisingly found that a microstructurally dense amorphous aluminophosphate material can be prepared using a low-cost precursor of phosphorous pentoxide and hydrated aluminum nitrate, in ethanol or other fluid media. Pyrolysis of the precursor at temperatures above 500 C yields a stable microstructurally dense amorphous aluminophosphate material which is resistant to crystallization up to 1400 C.

More importantly, it was surprisingly found that the precursor solution has excellent film forming and adhesion characteristics to metal & alloy, glass, and ceramic substrates. Without being bound to any theory, it is proposed that the adhesion is primarily promoted by phosphate bonding between the constituents in the precursor solution and the metallic substrate. As mentioned above, phosphate bonding is well known for improving adhesion between metal and inorganic and between ceramic materials. The higher curing temperatures utilized in the present invention (above 500 C) helps in promoting the adhesion. As the precursor is decomposed in ambient air at these elevated temperatures, some oxidation of the metal substrate is induced which leads to the formation of metal oxide (either as layer or as discrete islands). The phosphorous contained in the precursor, at least partially, bonds with the oxide via a phosphate link, which enables good adhesion between the substrate and the deposited film after curing. Prior art methods do not offer this advantage. This leads to a well-adhered film without requiring any special pretreatment or separate deposition of an underlayer to promote adhesion.

Embodiments of the aluminophosphate compounds, compositions and/or materials of this invention inventive compounds, compositions and/or materials are available under the Cerablak trademark from Applied Thin Films, Inc. Various considerations relating to this invention are disclosed in U.S. Pat. Nos. 6,036,762 and 6,461,415 and pending patent application Ser. Nos. 10/266,832 and PCT/US01/41790, each of which are incorporated herein in its entirety.

Post analysis of metal-coated films with the inventive compounds, compositions and/or materials show characteristics of an "interfacial layer" that is different in its chemical form compared to the substrate or the deposited film. Observing coated metals or alloys, under the optical microscope, often reveals a colorful layer underneath the transparent film of the inventive compounds, compositions and/or materials. For example, x-ray diffraction of films deposited on mild steel show peaks corresponding to the formation of iron oxide ($Fe_2O_3$). However, in other cases, the interface layer is indirectly observed. The TEM micrograph of the film deposited on stainless steel does not, for instance, reveal the presence of an interlayer, however, FTIR and Raman spectroscopic analysis show absorption corresponding to bonds that cannot be assigned to either the inventive compounds, compositions and/or materials or the substrate or any oxide that may have formed on the substrate. It is believed that M—O—P bonds are formed at the interface during the curing process that helps in achieving the excellent adhesion observed. Thus the final architecture of the coated material can be defined to contain component between the substrate and the aluminophosphate an additional interface or adhesive layer, which may comprise of a continuous phosphate-bonded metal oxide or an oxide layer linked to phosphate groups of the film, or mixtures thereof. Thus, the benefits of utilizing the said precursor system along with a suitable curing process yields a well-adherent glassy film.

Upon exposing the coated alloy to higher temperatures (above 800 C), it has been observed that the oxide formation underneath the deposited coating is substantially reduced, and furthermore, the composition of the oxide scale is substantially different from that observed for uncoated materials. Without being bound to any theory, it is believed that the coating, due to its low oxygen diffusivity, establishes a lower partial pressure of oxygen at the coating metal interface, at a given temperature, which helps in formation of more stable oxides of alloy constituents. Further evidence of this phenomenon with specific examples are provided herein.

Using a dip-coating process (described in detail below), a thin, dense, smooth, hermetic, transparent, and continuous glassy coating is formed on substrate surfaces. The precursor solution has low enough viscosity such that a uniform film can be deposited on complex-shaped substrates. Various examples described below provide evidence for its formation, durability, and stability under harsh exposure conditions. Specific monomeric or polymeric species in precursor solution facilitate the formation of hermetic and continuous film. During curing of sol-gel films, many events take place almost simultaneously: solvent evaporation, gelation and stiffening leading to shrinkage and densification of the film. If stiffening of the film occurs at an early stage, less relaxation will be allowed and films will be porous and/or cracked. Not wishing to bound by any theory we believe the combination of low hydrolysis-condensation rates and fast removal of organics is the key to form a crack-free, hermetic coating using the precursor solution discussed in the present invention.

The material tends to form over a wide range of aluminophosphate compositions and stoichiometries such that a particular Al/P ratio can be selected to suit the needs for a specific application. Al-rich compositions are more thermally stable in the amorphous form. Stoichiometric or P-rich compositions also yield a dense material, but the thermal stability is limited. However, they may be useful in applications where the temperature limit do not exceed 1000 C. Stoichiometric aluminum phosphate refers to a compound or composition having an aluminum/phosphorous ratio of about 1/1.

Most surprisingly, it was found that the material has very low oxygen diffusivity such that it can serve as an excellent protective coating on substrates susceptible to high temperature oxidation. Because of this unique property, to serve as a protective hermetic coating, it is sufficient to deposit an ultrathin dense film of the material at a thickness of about 0.1 micron, more preferably at a thickness of about 0.5 microns, and most preferably a thickness of about 1 micron. Such thin coatings are not prone to cracking and delamination due to thermal expansion mismatch between coating and substrate.

The low-cost of the precursor material and deposition process also allows for its deposition as an overcoat or undercoat on conventional coatings. For example, it is well known in the art that thick (few mils) metal alloy coatings (such as MCrAlY) are deposited on substrates used in turbine engines, ethylene cracking furnaces, and the like. Deposition of an ultrathin overcoat of The inventive compounds, compositions and/or materials will provide a life enhancement of the underlying coating and thereby an enhancement of the substrate at very little additional cost. As an undercoat in MCrAlY with a TBC on top to help form stable alumina thermally grown oxide films during service. In addition, the inventive compounds, compositions and/or materials can be applied in the field during a plant shutdown or during routine maintenance to provide additional protection. Various examples are provided below that demonstrates its ability to protect metals, alloys, and ceramics from corrosion and oxidation at elevated temperatures.

Accordingly, from a broader perspective, the present invention includes a composite comprising a metallic substrate, a substantially amorphous, substantially non-porous aluminophosphate film and a component therebetween. Such a component comprises a phosphate group in bonded interaction with an oxide of a metal component of the substrate. The aluminophosphate film comprises an aluminum content about, less than, or greater than stoichiometric on a molar basis relative to the phosphorous content of the film.

In certain embodiments, the film of such a composite further comprises nanoparticles, such particles including but not limited to carbon, a metal compound and combinations thereof. Without limitation, metal compound nanoparticles include those described herein, but can also be selected from those materials described in the aforementioned incorporated patents and patent applications. Regardless, in certain embodiments, the substrate can be a steel alloy such that the aforementioned phosphate group is in bonded interaction with an iron oxide, a chromium oxide or a combination thereof, and such bonding interaction promoted, in situ, during curing in formation of the film or coating. Likewise, regardless of nanoparticulate inclusion or substrate identity, the aluminophosphate film of such a composite can have a thickness dimension of about 0.05 micron to about 10 microns. In various embodiments, such a film can be dimensioned from about 0.1 micron to about 1.0 microns. As described elsewhere herein, depending upon thickness, such a film can be transparent or opaque, as may be needed for a desired end-use application.

In part, the present invention can also provide a high-temperature stable composition comprising an aluminophosphate compound, substantially amorphous with carbon nanoparticles therein. As mentioned above, the aluminophosphate compound of such a composition can vary over a range of stoichiometric relationships. In certain embodiments, where compositional stability may be required at temperatures up to and exceeding about 1400° C., the aluminophosphate compound has an aluminum content greater than stoichiometric on a molar basis relative to the phosphorous content. Regardless, such a composition can further, optionally, include nanoparticles of a metal compound, as described above. Alternatively, as compared to the prior art, such a substantially amorphous aluminophosphate compound is without or substantially absent chloride ion, such absence as can be indicated with chloride levels or concentrations less than those disclosed in the corresponding patents of the prior art.

In part, the present invention can also include a method of using an aluminophosphate compound to lower the surface energy of the substrate. Such a method comprises (1) providing a precursor to an aluminophosphate compound, such a precursor further comprising an aluminum salt and phosphorous pentoxide in a fluid medium; (2) applying such a medium to a substrate; and (3) heating the applied medium for a time and at a temperature sufficient to provide a non-wetting, substantially amorphous and substantially non-porous aluminophosphate compound on the substrate. In certain embodiments, as disclosed herein and by way of those incorporated patents and applications, the fluid medium can comprise an alcoholic solution of an aluminum salt and phosphorous pentoxide. Application techniques vary as described herein, but include, without limitation, dip-coating and spraying. Illustrating implementation of such a method is the use of an aluminophosphate compound on a substrate for non-wetting interaction with molten aluminum.

Accordingly, the present invention can also include a composite comprising a metallic substrate and a substantially amorphous, substantially non-porous aluminophosphate film on the substrate, such that the composite has a surface energy lower than that initially available through use of such a substrate, alone, such a surface energy as would be understood by those skilled in the art and in accordance with the structural, compositional and/or physical relationships described herein.

In general, many polymer or organic materials are known to have the lowest surface energy due to the terminating hydrocarbon groups with fluorine-based compounds providing a more enhanced effect in lowering surface energies. Such surfaces provide non-stick non-wetting or hydrophobic property to such surfaces. Polytetra fluoro ethylene (PTFE) is the most well known non-stick material widely used in many applications including cookware. A surface energy value of about 18 mN/m2 has been measured on PTFE surfaces. However, metal, ceramic, and glass surfaces have relatively higher surface energies with metals and alloys, in general, exhibiting the highest surface energies and glass having the lowest among these groups of materials. For many applications, it is desirable to lower surface energies of metals, ceramics, and glass. Surface modification techniques, including deposition of polymers are routinely used in industry to provide a lower surface energy. Such properties can enable enhanced flow characteristics of fluids (including molten polymers, oils, aqueous and other organic solutions), maintain relatively clean surfaces, and provide a low-friction surface.

Polymer coatings are not durable. The Inventive Material deposited as a relatively smooth, substantially non-porous, and amorphous film on steel components yields a low energy surface (~32 mJ/m$^2$). This is relatively close to surface energies of certain polymers such as polypropylene. With the hard, thermally stable, durable, abrasion- and corrosion-resistant nature of the film, the low surface energy of the Inventive Material can be exploited for a number of applications, including high temperature applications, such as protective films for molten metal processing. In addition, the ability of the film to reduce surface roughness of substrates will further enhance performance during service. It is also possible to lower the surface energy even further by varying the Al/P composition and other processing parameters.

For the purposes of the present compounds, compositions, materials and/or methods, the following expression(s) and word(s), unless otherwise indicated, will be understood as having the meanings ascribed thereto by those skilled in the art or as otherwise indicated with respect thereto:

"Aluminophosphate" means a compound, composition and/or material comprising aluminum and phosphate. Without limitation, such a compound, composition and/or material can be represented with a formula $AlPO_4$, wherein the aluminum and phosphate components thereof can vary over the range of stoichiometric relationships known to those skilled in the art made aware of this invention.

"Corrosion" means to any change in the metal which leads to oxidation (conversion) to the corresponding metal cation with formation of a species X. Such species X are generally (optionally hydrated) metal oxides, carbonates, sulphites, sulphates or else sulphides (for example, in the case of the action of $H_{25}$ on Ag).

"Metallic substrate" means any substrate which consists entirely of one or more metals or has at least one metallic layer on its surface.

"Metal" and "metallic" mean not only pure metals but also mixtures of metals and metal alloys, these metals and metal alloys as may be susceptible to corrosion, but for employment in conjunction with this invention.

"On" means, in conjunction with a compound, composition and/or material coating of this invention the position or placement of such a compound, composition and/or material coating in relation to a corresponding substrate, notwithstanding one or more layers, components, films and/or coatings therebetween.

Accordingly, this invention may be applied with particular advantage to metallic substrates comprising at least one metal from the group consisting of iron, aluminium, magnesium, zinc, silver and copper, although the scope of application of the present invention is not restricted to these metals. Among the metal alloys which may particularly profit from the present invention, mention may be made in particular of steel, titanium, nickel and copper alloys.

Without limitation, specific fields of application and examples of the use of the present invention include the following:

construction, e.g. support and shuttering material made of steel, face supports, pit props, tunnel and shaft lining constructions, insulating construction elements, composite sheets comprising two metal profile sheets and an insulating metal layer, shutters, framework constructions, roof structures, fittings and supply conduits, steel protection boards, street lighting and street signage, sliding and rolling lattice gratings, gates, doors, windows and their frames and panels, gate seals or door seals made of steel or aluminium, fire doors, tanks, collecting vessels, drums, vats and similar containers made of iron, steel or aluminium, heating boilers, radiators, steam boilers, turbine parts, halls with and without internals, buildings, garages, garden houses, facings made of sheet steel or aluminium, profiles for facings, window frames, facing elements, zinc roofs;

vehicles, e.g. body parts of cars, lorries and trucks made of magnesium, road vehicles comprising and including aluminium, electrical articles, rims, wheels made of aluminium (including chrome-plated) or magnesium, engines, drive elements for road vehicles, especially shafts and bearing shells, impregnation of porous die cast components, aircraft, marine screw propellers, boats, nameplates and identification plates;

household and office articles, e.g. furniture made of steel, aluminium, nickel-silver or copper, shelving units, sanitary installations, kitchen equipment, lighting elements (lamps or lights), solar installations, locks, fittings, door and window handles, cookware, fryware and bakeware, letterboxes and box-like constructions, reinforced cabinets, strongboxes, sorting, filing and file-card boxes, pen trays, stamp holders, front plates, screens, identification plates, scales;

articles of everyday use, e.g. tobacco tins, cigarette cases, compacts, lipstick cases, weapons, e.g. knives and guns, handles and blades for knives or shears and scissor blades, tools, e.g. spanners, pliers and screwdrivers, screws, nails, metal mesh, springs, chains, iron or steel wool and scourers, buckles, rivets, cutting products, e.g. shavers, razors and razor blades, spectacle frames made of magnesium, cutlery, spades, shovels, hoes, axes, cleavers, musical instruments, clock and watch hands, jewelry and rings, tweezers, clips, hooks, eyes, grinding balls, bins and drainage grilles, hose and pipe clips, sports equipment, e.g. screw-in studs and goal frames.

Articles including metal parts like catalytic converters, photovoltaic cells may be coated with the inventive material. Alternatively, high emissivity coatings may be useful for protective coatings for metallic thermal protection systems, as well as increasing heat transfer efficiency for industrial and consumer use, such as glass manufacturing, energy and metal manufacturing, as well as duct linings, firewall materials, heat shields for xenon lights, and high temperature filters for liquid non-ferrous metals.

DETAILED DESCRIPTION OF CERTAIN EMBODIMENTS OF THE INVENTION

The inventive compounds, compositions and/or materials is a sol-gel derived amorphous aluminum phosphate-based material. The inventive compounds, compositions and/or materials can be synthesized over a wide range of aluminum to phosphorous ratios, including from about 1/1 to about 10/1. The inventive compounds, compositions and/or materials is highly inert to chemical attack, thermally stable beyond 1400° C., and is sufficiently transmissive to light in the visible, IR, and UV ranges (200-2500 nm). High temperature oxidation tests have shown that the inventive compounds, compositions and/or materials is also highly impervious to oxygen ingress.

The inventive compounds, compositions and/or materials can be deposited as a dense, pinhole-free thin coating on substrates using a simple dip, paint, spray, flow or spin coating process at relatively low temperatures (500° C. or above) (FIG. 1). It has excellent potential to be scaled up without significant capital investment to produce continuous coatings on a variety of substrates. As a highly covalent inorganic oxide, the inventive compounds, compositions and/or materials is chemically inert (like alumina) and thermally stable material. The inventive compounds, compositions and/or materials is a unique metastable amorphous material stable to temperatures beyond 1200° C. Testing of The inventive compounds, compositions and/or materials has demonstrated the electrical insulating property of the film and the continuity, hermiticity and, protective nature of the coating.

Figure 2:
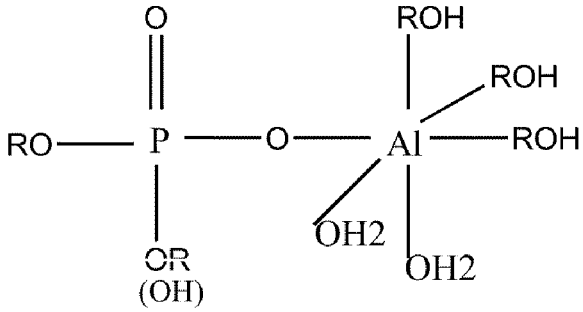
FIG. 2. A chemical structure of aluminophosphorus complexes present in the precursor solution of the inventive compounds, compositions and/or materials.
Figure 2:
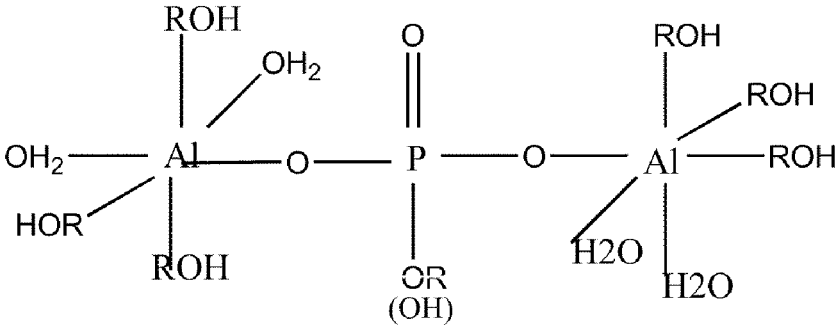

The species present in a precursor solution of inventive compounds, compositions and/or materials can be used to derive the properties of the solid inventive compounds, compositions and/or materials. Based on the collective experimental evidence, we believe the principal ingredients of the precursor solution comprise of complexes that contain Al—O—Al linkages. This inference is primarily based on identification of Al—O—Al linkages in precursor solutions, dried gels, and calcined powders. $^{31}$P nuclear magnetic resonance (NMR) spectra of the precursor solutions show at least one of two prominent peaks near −5 ppm and −12 ppm, which is assigned to aluminophosphate complexes (1) and (2) respectively, with a mixture of alcohol and water molecules coordinated to aluminum (FIG. 2). Further $^{31}$PNMR analysis of the precursor solution shows predominantly the presence of two phosphate esters bonded to one or two aluminum atoms. The reactivity of these complexes are sterically restricted by the P═O groups and hydrolytically stable P—OR groups (See for reference, Sol-gel synthesis of phosphates, J. Livage et al., Journal of Non-Crystalline Solids, 147 & 148, 18-23 (1992)). Not bound by any theory, the stability of the complexes can restrict the condensation of these complexes (decreases the kinetics of condensation) forming an extended three dimensional Al—O—P network. Accordingly, the shelf-lives of precursor solution are extended and the solutions remain clear for several months to years. Further, the alcohol-based solvent offers excellent film forming ability while the base phosphate chemistry allows for chemical bonding with most substrates resulting in strong adhesion.

Figure 3:
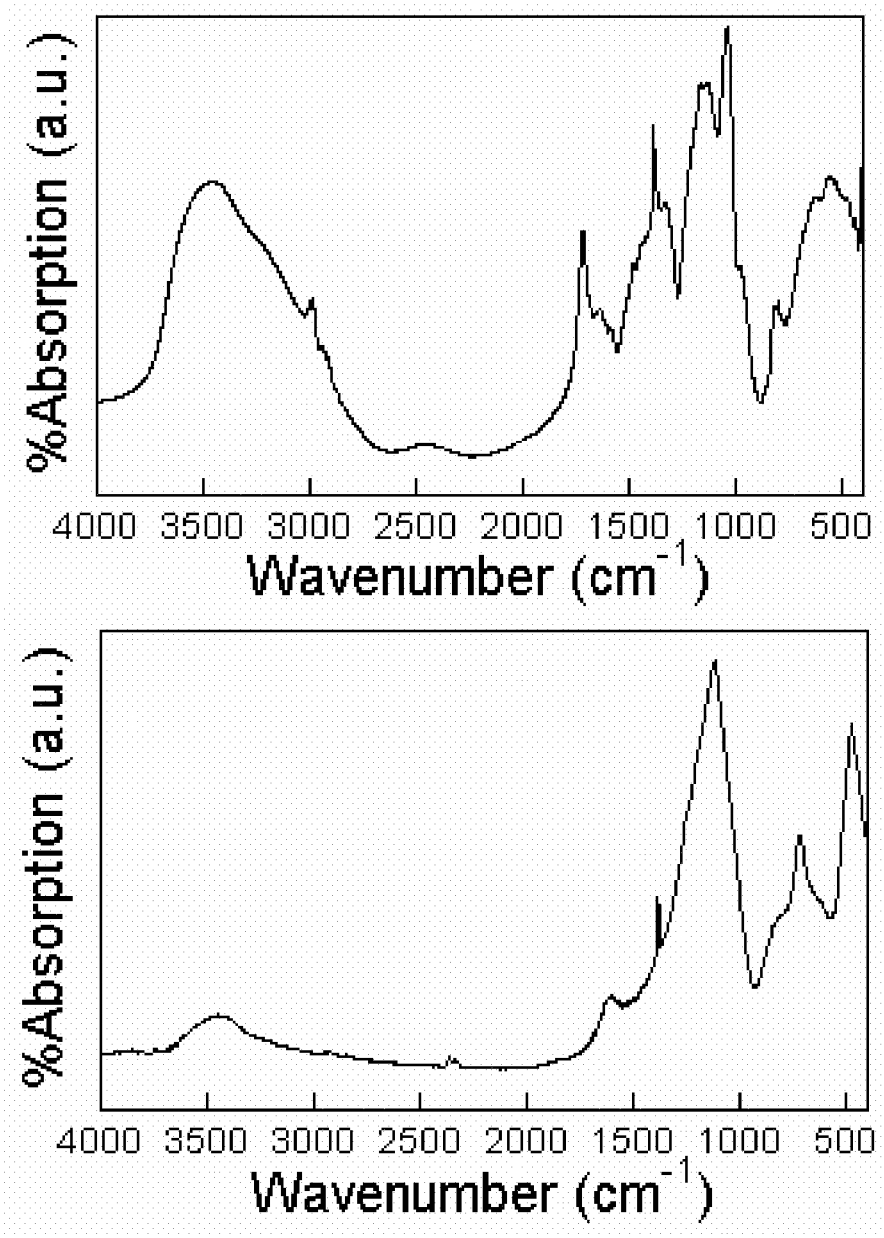
FIG. 3. FTIR spectra of an inventive compound, composition and/or powder material with Al/P=1.75/1 heat-treated in air (A) 150° C. (B) 1100° C.

These results support the formation of multi-cation clusters with Al/P ratio ≧2 in solution leading to [O═P—O—Al—O—Al] cluster formation. Thus both requirements of a) P═O and b) Al—O—Al to be part of a cluster unit seem to be important. This trend is consistently observed with a number of other synthetic routes for producing the inventive compounds, compositions and/or materials. The species common to all solutions that yield inventive compounds, compositions and/or materials are those consisting of at least [O═P—O—Al—O—Al] links. FIG. 3 shows FTIR of dried powder at 150° C. and calcined at 1200° C. products, respectively. It is clear from FTIR data that at 150° C., both P═O and Al—O—Al species are observed. The observation of the P═O stretching at a much higher frequency (1380 $cm^{-1}$) indicates that the terminal oxygen atom in P═O bond is uncoordinated.

Studying the evolution of the inventive compounds, compositions and/or materials from the gel state also provides interesting insights. Upon pyrolysis, cross-linking of [O═P—O—Al—O—Al] moieties continue over a range of temperatures eventually resulting in a "[—$PO_4$—$AlO_4$—$AlO_6$—$AlO_4$—$PO_4$—]" fragment in the high-temperature amorphous framework. The presence of this type of linkage in the calcined material is established from combined data of NMR and FTIR spectroscopy. The inventive compounds, compositions and/or materials contains tetrahedral coordination for aluminum, along with "distorted" octahedral aluminum, the intensity of which increases with excess aluminum content. This is unlike the exclusive tetrahedral coordination for aluminum observed in all crystalline polymorphs of $AlPO_4$. The $^{27}$Al NMR data suggests a distorted environment for the tetrahedral Al, whereas the corresponding $^{31}P$ NMR shows an undistorted environment for $[PO_4]$ groups. Combining these two data we conclude that $[PO_4]$ groups are linked only to $[AlO_4]$ groups which in turn are linked to $[AlO_6]$ groups. Correspondingly, Al—O—Al bending mode vibrations at 825 $cm^{-1}$ in the FTIR spectra, the intensity of which also scales proportionally with excess aluminum content, suggests a direct linkage between $[AlO_6]$ and $[AlO_4]$ polyhedra.

The multicluster P—O—Al complexes identified above represent a new way for synthesis of amorphous oxide materials. Besides the precursor system used in this specific case (aluminum nitrate and phosphorous pentoxide in alcohol), essentially any precursor system that yields complexes with P═O and Al—O—Al moieties (which are linked with each other) will yield the inventive compounds, compositions and/or materials. Regardless of the precursor system used, the formation of these complexes appear to yield the inventive compounds, compositions and/or materials. Such complexes may be further modified with other additions (silicon, zirconium, lanthanum, titanium) which can potentially enhance the amorphous characteristics or enhance the thermal stability of these materials.

Although many coating techniques can be used with the precursor solution, dip-coating, spraying painting and flow coating are most often used. All are low-cost, easy to apply and scale up. We have been using these techniques successfully on various substrates, including metals, alloys, glass, ceramics and others. The inventive compounds, compositions and/or materials solutions show good wetting properties and is particularly significant when alcohol (preferably ethanol, but other alcohols including, but not limited to, methanol, isopropanol, butanol can be used as well) is used as the solvent, although good wetting properties can be attained even using aqueous solutions. Many oxidation studies have proven the hermiticity of the coating and the advantage of thin inventive compounds, compositions and/or materials films. Coatings on stainless steel coupons can withstand treatments of 1000° C. or more without cracking.

The coating composition employed according to the present invention may be applied onto the metallic surface according to conventional coating methods. Examples of techniques which may be employed are dipping, spinning, spraying or brushing. Particularly preferred are dipping and spraying processes.

The inventive compounds, compositions and/or materials solution has been applied with a variety of methods and compositions. The inventive compounds, compositions and/or materials has been coated onto a wide variety of substrates, including stainless and mild steel, titanium, nickel, iron, aluminum alloys glass, ceramics and carbon among many other substrates. After application of the coating, it is dried to remove solvent and cured to remove the organics and nitrates (or other salt components from the precursor). The coating can be cured in the furnace or with a portable quartz infrared heat lamp. The coatings cure quickly and are stable. Although the (final) temperature of the thermal densification must also be determined in consideration of the heat resistance of the metallic surface, said temperature is usually at least 300° C., particularly at least 400° C. and particularly preferred at least 500° C. If the metallic surface is sensitive to oxidation, especially at such high temperatures, it is recommended to carry out said thermal densification in an oxygen-free atmosphere, e.g. under nitrogen or argon.

During the curing process, bonding with substrate materials is promoted. Metallic or alloy substrates, in particular, partially oxidize and form an oxide scale (either partially or a continuous scale depending on substrate composition, chemistry, and surface roughness) which then forms a strong bond with the coating material during the curing process. In many cases, the precursor solution may enable direct phosphate bonding of the metal surfaces which also helps in improving adhesion. Although the exact nature of the chemistry of the interface layer (existing between the substrate and the applied coating) is not known, evidence from optical microscopy, FTIR and Raman spectroscopy, and x-ray diffraction methods show that the characteristics of the interface layer is different from either the substrate or the metal substrate. This has been observed both with mild steel and stainless steel substrates as described in Examples 30 and 31.

Thus the use of curing temperatures above 500 C in oxidizing environment or ambient air is favorable for obtaining fully cured coatings as well as attaining good adhesion with substrates. Although lower curing temperatures can be used to cure the coatings by exposing for longer periods of time, temperatures in excess of 500 C is preferred to induce partial oxidation of the substrate or to promote direct bonding via phosphate groups with substrate constituents. Those skilled in the art will recognize that the temperatures, environments, and time of exposure can be adjusted over a wide range to accomplish the various objectives discussed above. Use of higher temperatures and higher partial pressure of oxygen in the ambient is preferred for fast curing suitable for many applications which will also reduce processing cost.

The adhesion with substrates can be further improved with altering the Al/P ratio according to the substrate composition and oxide scale chemistry. Excellent adhesion have been achieved with a number of alloy substrates including various grades of steel alloys, nickel, Inconel, advanced nickel and titanium alloys, aluminum, copper, titanium, and alloys thereof. Annealing the coated materials to even higher temperatures provide further improvements in adhesion, however, extensive oxidation of the substrate may lead to thick enough oxide scales which may result in cracking or spallation at the oxide scale/substrate interfaces. Annealing to ultra-high temperatures (above 1000 C) may result in some loss of phosphorous, depending on the environment, however, the dense nature of the coating is still maintained such that protection is still considered good. Further description of the oxidation mechanism on steel and advanced alloys are provided below with specific examples attached. Aluminum and its alloys, due to their heat sensitivity can also be cured with other surface heating techniques such as laser heating, IR lamps, and the like. Thus, if the heating is restricted to the surface of the substrate, mechanical and chemical degradation of the substrate can be avoided to a large extent since compositional or microstructural changes occurring within the substrate may affect its physical and mechanical properties. However, even curing of coating on aluminum alloys have been accomplished using a furnace at temperatures ranging from 500-550° C. Such coated alloys have shown good performance in salt spray tests demonstrating good corrosion protection. For many substrates, the application of a coating of an inventive compound, composition and/or material can be combined with the tempering process, typically used to harden metals and alloys. This will help in reducing the number of processing steps required to make the final article for a given application.

The coating composition applied on the metallic surface will subsequently be thermally densified to form a vitreous layer. Prior to said thermal densification a conventional drying operation of the coating composition at room temperature and/or slightly elevated temperature will usually be carried out. It remains to be noted that the thermal densification may optionally also be effected by IR, UV or laser heat sources. Also, it is possible to produce structured coatings by selective action of heat thereon.

Slurries have also been made by dispersing a powder in a solution of an inventive compound, composition and/or material. Slurry coatings were made to increase the thickness or functionality of the coating. Different powders were mixed into the solution. Slurry coatings can be applied by any of the above coating methods. When synthesized as a powder, the inventive compounds, compositions and/or materials contain nanoinclusions of glassy carbon completely embedded in the amorphous material. These carbon inclusions help to provide high emissivity characteristics to the powder. High emissivity coatings can be made by making a coating from a slurry of black compounds, compositions and/or material particles of this invention dispersed in solution or a suitable medium. The inventive compounds, compositions and/or materials may also be used as a protective binder for pigments. It is also possible to synthesize such compounds, compositions and/or materials without carbon inclusions with appropriate selection of precursor formulations.

The low-cost associated with the present invention and coating technology allows for combined options to be considered. It is expected that the inventive compounds, compositions and/or materials can enhance the oxidation resistance behavior of a wide range of alloys, even alloys with high oxidation resistance. It can be deposited on weld areas where morphological non-uniformities and compositional variations are bound to exist. The inventive compounds, compositions and/or materials are also amenable to field repair, or could be applied during shut-downs where deposits on wash walls or other areas are cleaned. Spraying is a suitable process for depositing inventive compounds, compositions and/or materials coatings, and could be used as a field-repair process.

Examination of coated substrates under 1000× magnification, using an optical microscope shows the continuous character of the coating. Compliance of coatings of the inventive compounds, compositions and/or materials on steel foil has been demonstrated where the foil has been bent (>120 degrees) several times without any sign of delamination, thus demonstrating excellent adherence of the thin film.

Thin coatings are often preferred to avoid delamination from thermal treatments, for ease of application at lower costs and their compliance even in case of large CTE match between the substrate and the coating. If an insulating layer is required, thicker coatings are preferred for providing adequate electrical insulation and for providing the desired diffusion barrier characteristics during deposition of functional overlayers. Since the inventive compounds, compositions and/or materials are extremely inert to chemical attack, and has a low dielectric constant, it should serve as an excellent insulation and diffusion barrier around 500° C. even at thickness of about 2000-5000 Å. A dielectric breakdown strength of 190V has been measured for the inventive compounds, compositions and/or materials as a 100-500 nm thick film on stainless steel. Such dielectric constants can range from 3.3-5.6.

The inventive compounds, compositions and/or materials significantly limit the oxidation of metal/alloy substrates, and limit corrosion as well. In addition to providing protection, the present invention appears to change the chemistry of the growing oxide scale. Perhaps more significantly, the invention can be used to minimize the effects of accelerated corrosion due to surface roughness, and eliminates corrosion pitting, which is often observed on oxidized, metal/alloy substrates. Thus, a function of the inventive compounds, compositions and/or materials coating is in the early stages of oxidation where it protects sharp edges, planarizes the surface, and defects in an alloy surface.

Figure 4:
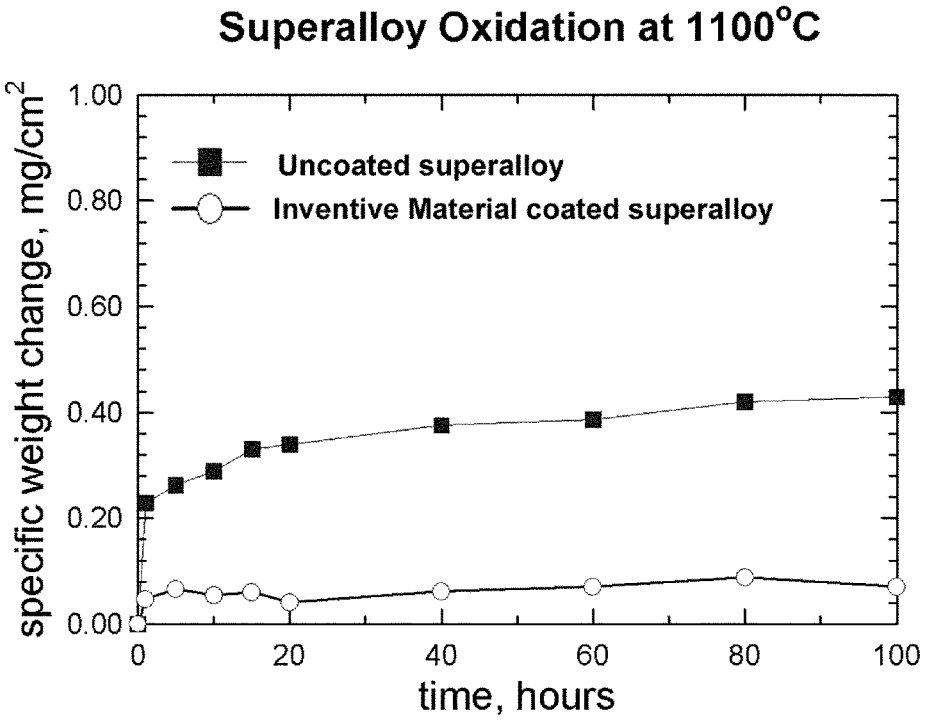
FIG. 4. Plot showing comparison of specific weight change between coated and uncoated nickel-based superalloy coupons exposed to 1100° C. in air for 100 h with one-hour thermal cycles.

The ability to protect nickel-based alloys at temperatures over 1000° C. for over 100 h has been successfully demonstrated. Two grades of nickel-based superalloys were coated with the inventive compounds, compositions and/or materials (~1 micron thick coating by dip coating process) and their oxidation behavior was studied under thermal cycling conditions. FIG. 4 show the oxidation behavior of the coated and uncoated alloys. Each data point on the curve represents a thermal cycle (RT-1100° C.). Thus the cumulative exposure time at temperature was around 100 hours. Both coated materials performed very well under the exposed conditions, especially considering the high temperatures used.

Figure 5:
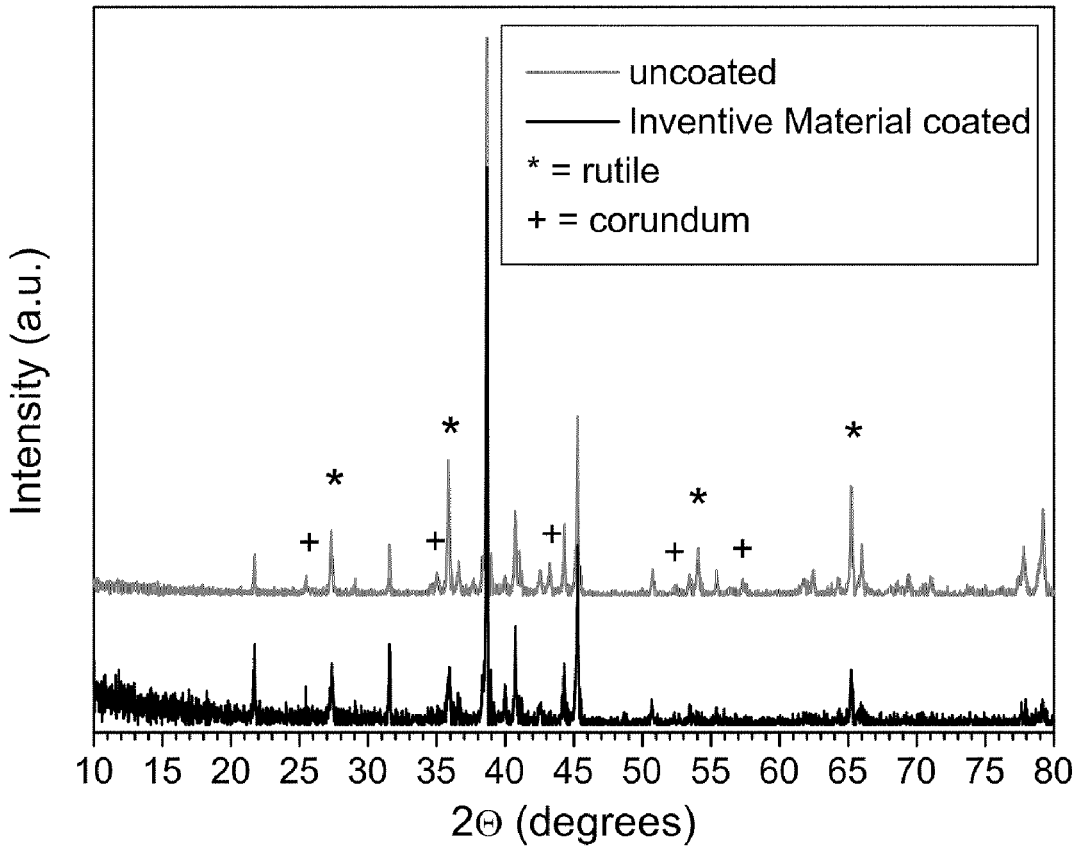
FIG. 5. X-ray diffraction spectra of coated and uncoated gamma-titanium aluminide alloy showing substantial oxide growth on the uncoated and minimal oxide growth on the coated substrate.

The inventive compounds, compositions and/or materials coatings were also tested on Inconel 718 at 760° C. under thermal cycling conditions. As described before, the coated materials were tested for 20 thermal cycles where subsequent surface examination showed the inventive compounds, compositions and/or materials was effective in its protection and, more importantly, no additional cracking or spallation was observed. The inventive compounds, compositions and/or material were used to coat a γ-titanium aluminide alloy, and heat treated, with an uncoated alloy for 100 h at 815° C. The uncoated alloy showed extensive growth of rutile titania and corundum alumina on the surface. The coated alloy showed significantly reduced oxide growth, as seen by x-ray diffraction (FIG. 5). All these studies combined suggest the inventive compounds, compositions and/or materials have excellent potential for use in protecting alloys intended for use a wide variety of elevated temperature applications.

Figure 6:
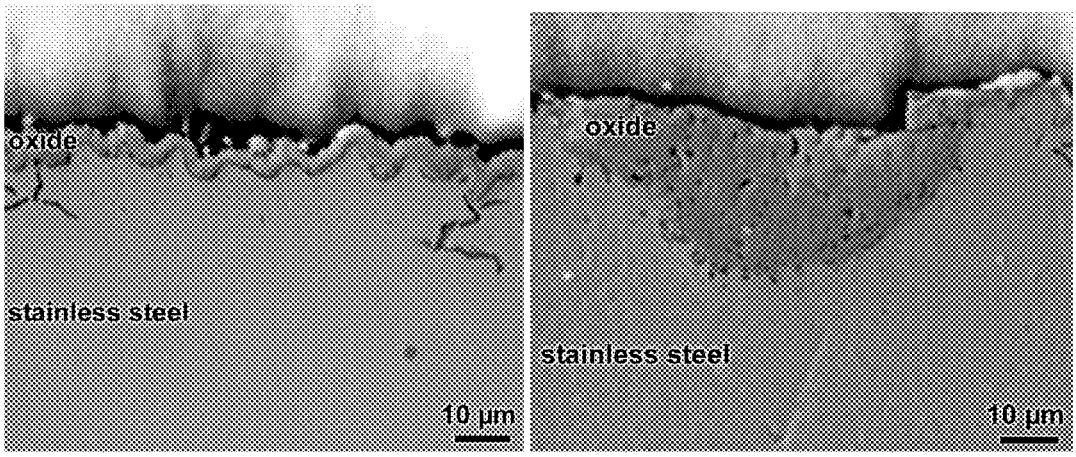
FIG. 6. SEM micrograph of cross-section of coated (left) and uncoated (right) AUS304 stainless steel annealed to 1000° C., 10 hr.

The inventive compounds, compositions and/or materials coatings have been shown to protect alloys against oxidation. Not wishing to be bound by any theory, it is believed that during the very early stages of oxidation a low $P_{O2}$ is established at the alloy such that only oxides stable in low $P_{O2}$ environments are formed (usually chromia for steels or alumina for nickel-aluminum based alloys). To illustrate, a piece of type-304 stainless steel was half-coated with the inventive compounds, compositions and/or materials and heat treated to 1000° C. for 10 hours in air. The coated half shows a dense, uniform, chromia-rich scale, while the uncoated half shows a non-uniform scale with deep pits of non-protective iron-rich oxide (FIG. 6).

It appears that the inventive compounds, compositions and/or materials provide significant benefits by modifying the growing oxide. Irrespective of the selection of the alloy, issues related to roughness or surface defects are bound to be of concern, and may require special pretreatments which can be expensive, environmentally unfriendly, and will generate waste. Surface-related defects affected the oxidation behavior for the uncoated materials. Despite the high quality finish, these factors dominated the oxidation behavior. For the intended applications, alloy materials may be fabricated using a wrought process which is certain to create surface defects, and this issue must be addressed. Furthermore, the simplicity and versatility of the inventive compounds, compositions and/or materials coating process and the inexpensive nature of the precursor solution may make it cheaper to deposit a compound, composition and/or material coating of this invention rather than performing many other, more expensive pretreatment of alloy surfaces.

For thermal barrier coating applications, growth of thick alumina scale between the bondcoat and ceramic coating leads to premature failure of the TBCs. Compounds, compositions and/or materials coatings of this invention can be deposited on McrAlY type bondcoats and then TBC deposited (preferably by e-beam PVD), whereby the growth of alumina scale during service is limited which will prevent catastrophic failure of TBCs due to spallation. A standard practice used in turbine manufacturing is to preoxidize the bondcoat material (MCrAlY type compositions) to improve the adhesion with the thermal barrier coating to be applied. Often, reducing environments are used to promote the preferential formation of alumina scales (as opposed to spinel and other oxides), see for example U.S. Pat. No. 5,856,027 Murphy. Such treatments in inert or vacuum significantly increases the cost of production and limits the production efficiency. A thin film deposited on MCrAlY can promote the formation of alumina scale even if it is annealed in ambient air. In addition, as the morphology of the surface is rough, sealing of defects by the coating may provide an added benefit. Furthermore, the presence of the oxidation-resistant glassy film may provide enhanced protection of the substrate during subsequent use.

The inventive compounds, compositions and/or materials can protect metals and alloys against corrosion from molten sulfates, encountered in combustion applications. Its compatibility with the trisulfates vary depending on the Al/P stoichiometry whereby Al-rich compositions appear to be more compatible. The non-wetting character may be useful in limiting the adhesion of ash particles to the metal/alloy components used in coal-fired combustion systems and other power generation plants.

Figure 7:
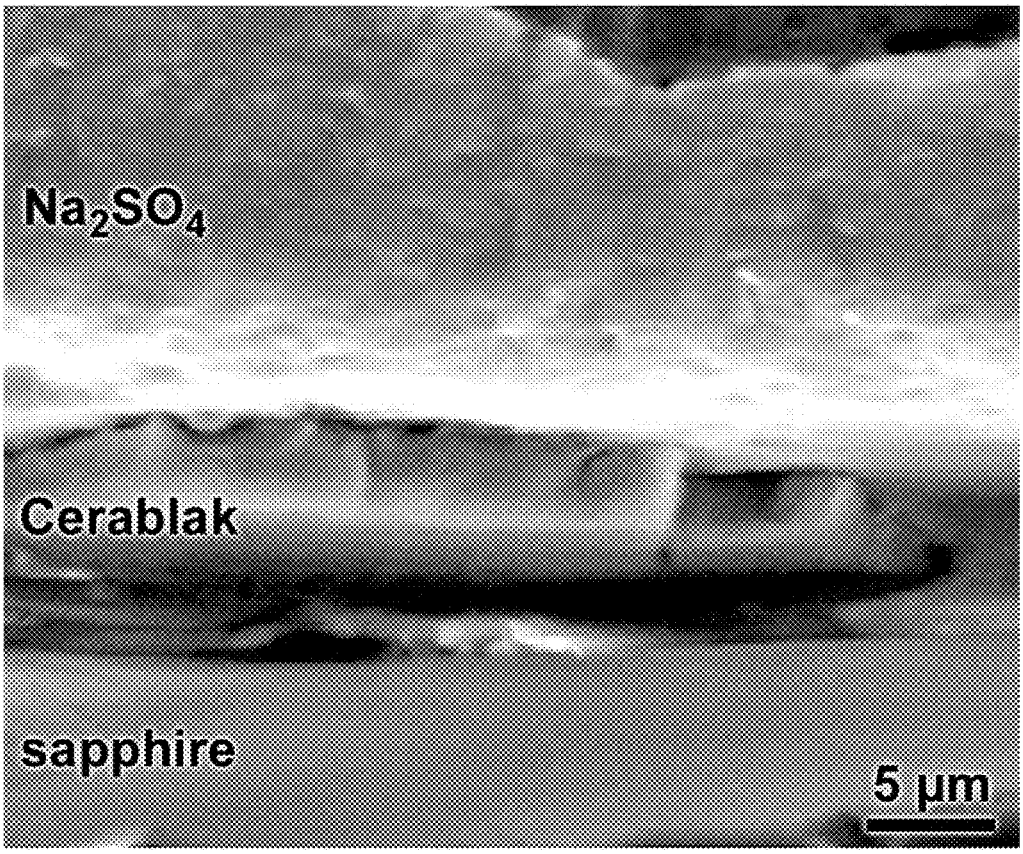
FIG. 7. Cross-section SEM micrograph of a thin film of an inventive compound, composition and/or material showing compatibility with molten sodium sulfate for 120 hrs at 900° C. in air, demonstrating the utility of this invention to protect metallic components from corrosion in sulfur-bearing environments, such as coal-fired power plants.

To assess the compatibility of the present compounds, compositions and/or materials with sodium sulfate, coatings thereof were deposited onto sapphire plates. Sapphire substrates were chosen to avoid the influence of oxide scale on the compatibility test. Sodium sulfate was placed on the coated sapphire pieces and annealed to 900° C., just above the melting point (884° C.). FIG. 7 shows a coated piece after 120 hrs of exposure. As apparent from the micrograph, the inventive compounds, compositions and/or materials, even at one micron thickness, were not degraded by the exposure.

Coatings for enhancing the corrosion resistance are suitable, for example, for iron and steel products, especially profiles, strips, plates, sheets, coils, wires and pipes made of iron, of unalloyed, stainless or otherwise-alloyed steel, either bright, zinc-plated or otherwise-plated, semifinished forged goods made of unalloyed, stainless or other alloyed steel; aluminium, especially foils, thin strips, sheets, plates, diecastings, wrought aluminium, or pressed, punched or drawn parts; metallic coatings produced by casting or by electrolytic or chemical processes; and metal surfaces enhanced by coating, glazing or anodic oxidation.

Coatings for enhancing the wear resistance are suitable, for example, for jewelry, timepieces and parts thereof, and rings made of gold and platinum. Diffusion barrier layers are suitable, for example, for lead fishing weights, diffusion barriers on stainless steel to prevent heavy metal contamination, water pipes, tools containing nickel or cobalt, or jewelry (anti-allergenic). Surface leveling/frictional wear reducing coats are suitable, for example, for seals, gaskets or guide rings.

Figure 8:
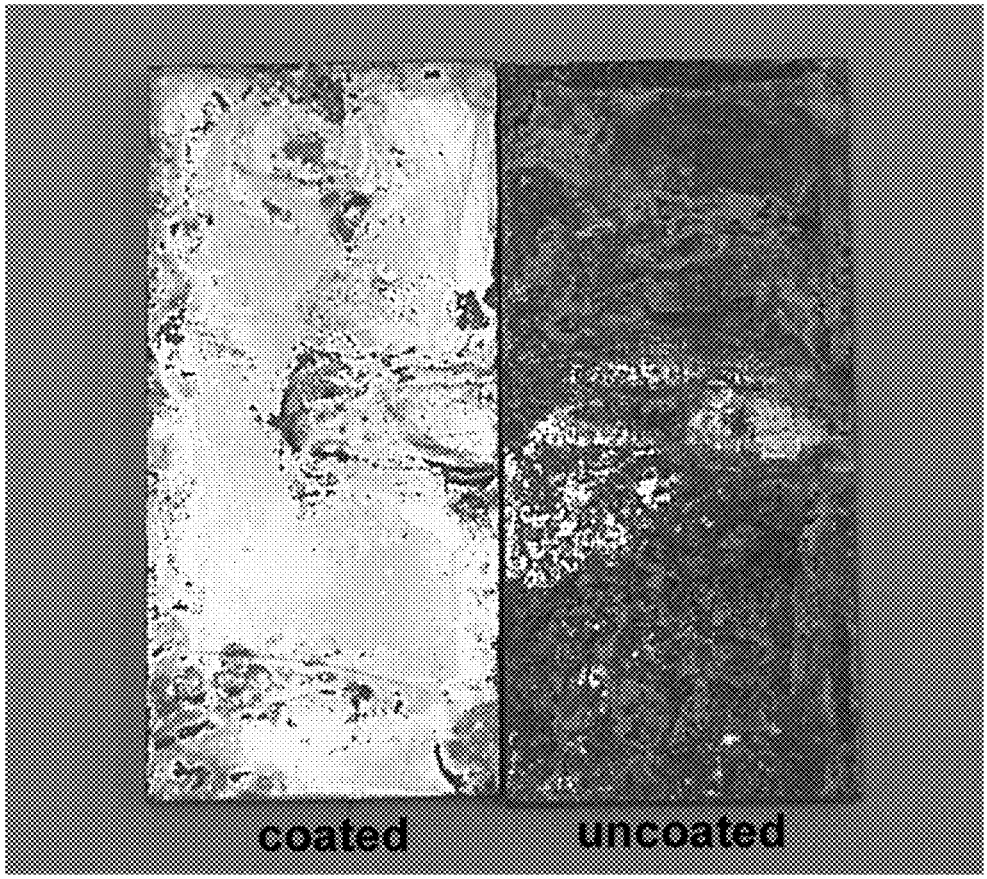
FIG. 8. Coated and uncoated Aluminum 2024 alloy after 115 h exposure to salt fog using ASTM B-117 specifications.

Steel, iron, aluminum and other alloys corrode readily in a humid and salty environment. The salt fog test is highly accelerated, allowing useful tests in a reasonable amount of time. Coatings of the inventive compounds, compositions and/or materials on aluminum and carbon steel coupons have been tested for preliminary evaluation in the salt fog apparatus, and show increased resistance to corrosion compared to aluminum coupons. After testing, the uncoated coupons showed corrosion over the entire piece, while most coated coupons only showed very localized corrosion with one of the coated coupons showing virtually no sign of corrosion. The corrosion on the coated pieces often occur where the surface finish is uneven. FIG. 8 shows the inventive compounds, compositions and/or materials coated and uncoated coupons after the salt fog test.

Non-wetting behavior is helpful to prevent corrosion in a humid/rainy or coastal environment. The inventive compounds, compositions and/or materials show non-wetting behavior to water and other liquids. Non-wetting characteristics are primarily due to the low surface energy associated with the high degree of covalency. It may also serve as an anti-static coating preventing solid particles, such as dust or lint from sticking to its surface.

Figure 9:
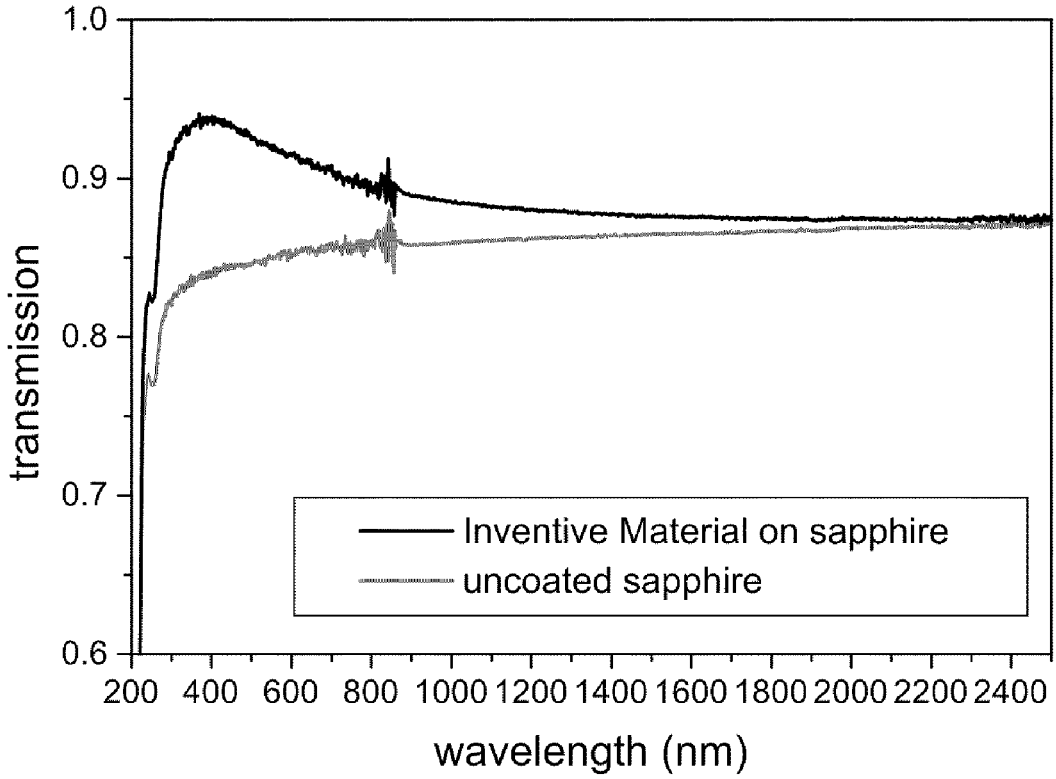
FIG. 9. Transmission spectra of an inventive compound, composition and/or material-coated sapphire (upper two lines) and uncoated sapphire (lower line).
Figure 10:
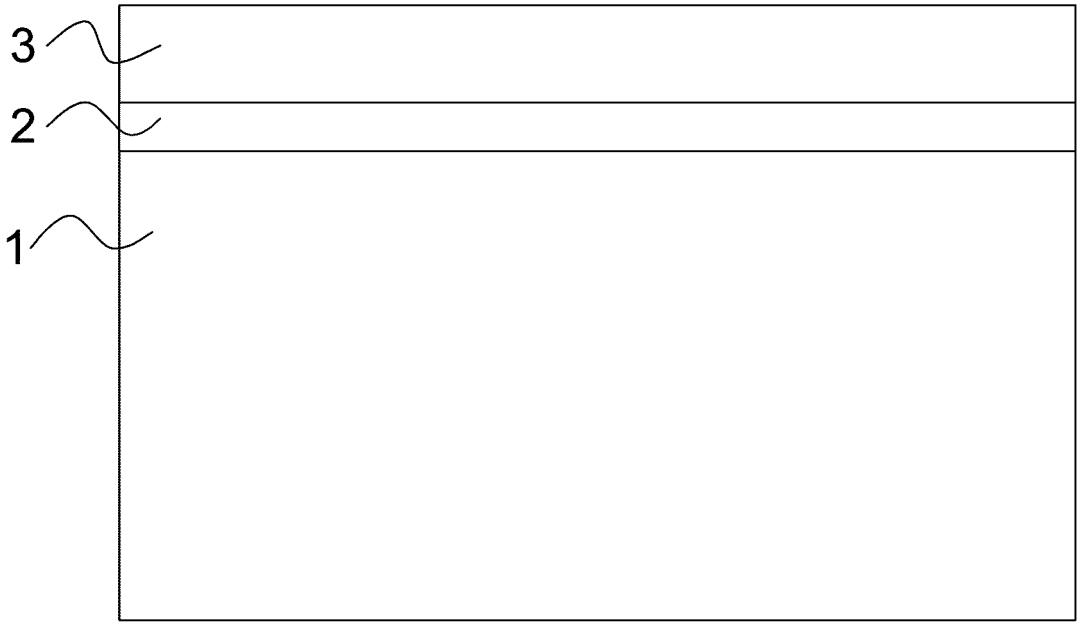
FIG. 10. Schematic illustration showing a coating of an inventive compound, composition and/or material (3) with adhesion layer (2) formed and promoted in situ while depositing the film on a metal or alloy substrate (1).

Transmission to light is important for many applications. A glass microscope slide coated with the inventive compounds, compositions and/or materials was compared to an uncoated slide. Such compounds, compositions and/or materials have been shown to be transmissive to radiation between 200-2500 nm. A coating was put on a sapphire plate, and the transmission properties were compared to an uncoated sapphire piece, cut from the same large plate. Two coated pieces were tested, one with a thicker coating than the other. FIG. 9 shows the transmission of the coated vs. uncoated sapphire plates.

The inventive compounds, compositions and/or materials could be used a protective coating against coke. Their non-stick properties, thermal stability, and protective nature is highly suitable for use in the petroleum industry where corrosive and high temperature environments are experience; deposition of coke in ethylene cracking tubes is a major problem; decoking process is expensive and is time-consuming; inventive compounds, compositions and/or materials coatings can be deposited on top of alloy coatings to avoid coke deposition. Coke formation is promoted by catalytic reaction between the metal substrate and hydrocarbons present in the gas stream. A substantially pore-free thin film, preferably hermetic, may serve as an excellent barrier to prevent contact between the metal and hydrocarbons. In addition, carburization of metal substrates degrade its mechanical properties. The coating will help prevent carburization of metals and alloys.

Yet another high temperature application of the inventive compounds, compositions and/or materials relates to their use as a coating for high-temperature protection of metal- or alloy-based thermal protection systems (TPS) to be used in reusable launch vehicles (RLVs). Such a material provides both oxidation protection to the underlying substrate and high emissivity characteristics. The powders retain the black or dark color for over 100 hours at 815° C. and over 24 hours at 1100° C. and retain high emissivity.

The present invention has also been demonstrated to protect substrates from attack from molten non-ferrous metals, such as aluminum and zinc, as well as molten polymers. The low surface energy of the inventive compounds, compositions and/or materials allows it to remain non-wetting to these and other materials.

The inventive compounds, compositions and/or materials can also be used to provide a low friction surface. The friction coefficient of inventive compounds, compositions and/or materials coatings on highly polished 440C stainless steel substrates was measured to be around 0.1.

The inventive compounds, compositions and/or materials show excellent adhesion to metals, alloys and ceramic/glass substrates, upon heat treatment to form the inorganic material. When deposited on a metal or alloy, the heat treatment allows a very thin oxide scale to form on the substrate surface, which enhances the adhesion of such compounds, compositions and/or materials to the substrate.

Nanoparticles or nanocrystals of varying chemistries can be embedded or encapsulated into the aluminophosphate amorphous material for inducing various functions including, but not limited to, optical, chemical, catalytic, physical, mechanical, and electrical properties. The prior art coatings are not robust enough to protect the nanocrystals and, in addition, processing of nanocomposites with a porous host will be a significant challenge

EXAMPLES OF THE INVENTION

The following non-limiting examples and data, in conjunction with the referenced figures, illustrate various aspects and features relating to the compounds, compositions, materials and/or methods of the present invention, including the preparation, application and/or use of corresponding films and coatings on a variety of substrates, such compounds, compositions and/or materials as are available through the synthetic methodologies described herein. In comparison with the prior art, the present invention provides results and data which are surprising, unexpected and contrary thereto. While the utility of this invention is illustrated through the use of several aluminophosphate compounds, compositions and/or materials and composites thereof, it will be understood by those skilled in the art that comparable results are obtainable with various other aluminophosphate compounds, compositions and/or materials, as are commensurate with the scope of this invention.

Example 1

264 g of $Al(NO_3)_3.9H_2O$ is dissolved in 300 mL ethanol. In a separate container, 25 g $P_2O_5$ (or other soluble phosphate ester) is dissolved in 100 mL ethanol which promotes the formation of phosphate esters and this solution is then added to the aluminum-containing solution. This solution refluxed for time sufficient to promote the formation of complex esters containing Al—O—P groups. This solution is clear and shelf-stable for years.

Example 2

Figure 11:
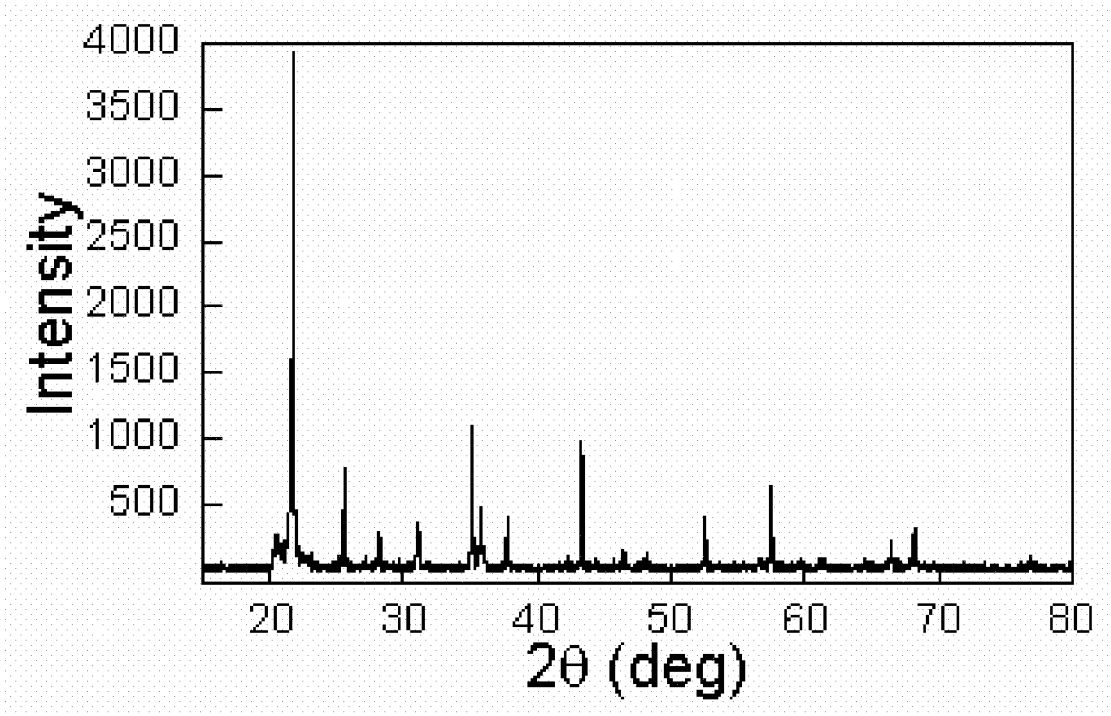
FIG. 11. A) Powder x-ray diffraction pattern of calcined material from example 2, showing crystalline aluminum phosphate and corundum form of alumina. B) $^{31}P$ NMR spectrum of solution from example 2, showing a resonance peak at −1 ppm, corresponding to unreacted triethylphosphate.
Figure 11:
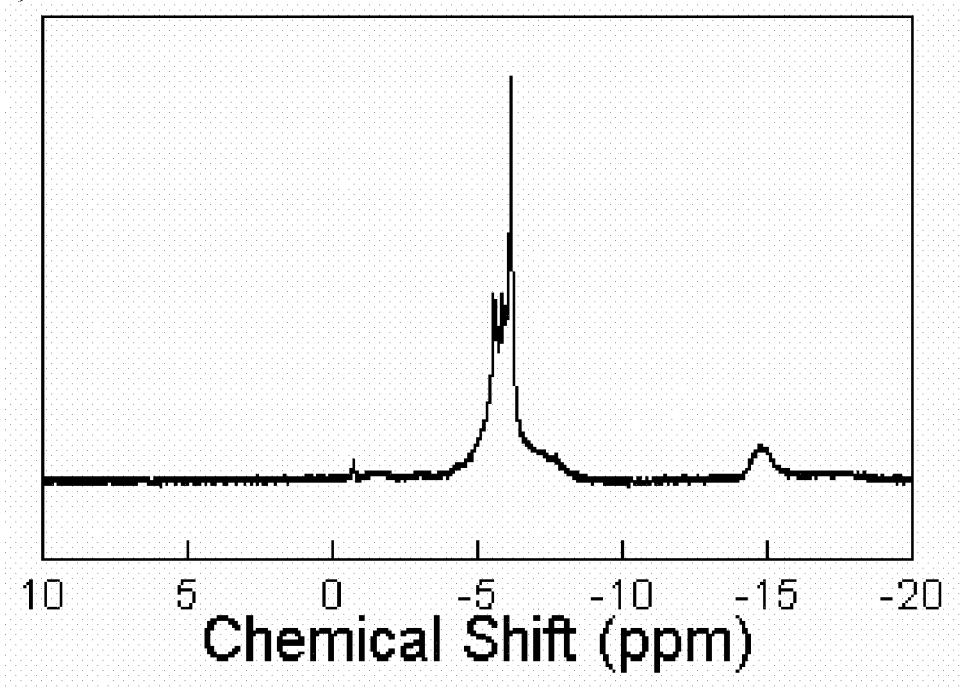

19 mL triethyl phosphate was mixed with 84 g of $Al(NO_3)_3.9H_2O$ in 181 mL of ethanol. After stirring for 30 min, the mixture was dried to form gel powder and annealed to 1100° C. for 1 hour in air. The x-ray diffraction pattern obtained shows highly crystalline aluminum phosphate and alumina phases, indicating that this mixture does not form amorphous aluminum-rich aluminum phosphate. The $^{31}P$ NMR of the solution showed peaks near 1 ppm, indicating that the phosphorous was not complexed with the aluminum to any significant extent (FIG. 11).

Example 3

Figure 12:
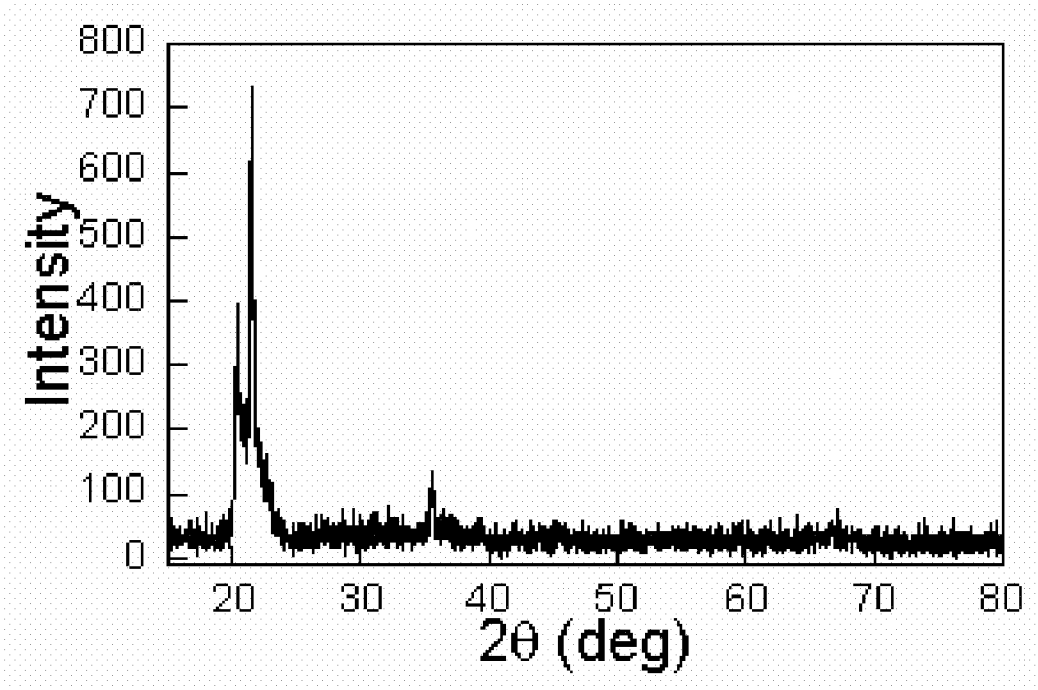
FIG. 12. A) $^{31}P$ NMR spectrum of solution from example 3, showing a resonance peak at −5.9 ppm, corresponding to aluminophosphate complex. B) X-ray diffraction pattern of calcined material from example 3, showing predominately amorphous aluminum phosphate.
Figure 12:
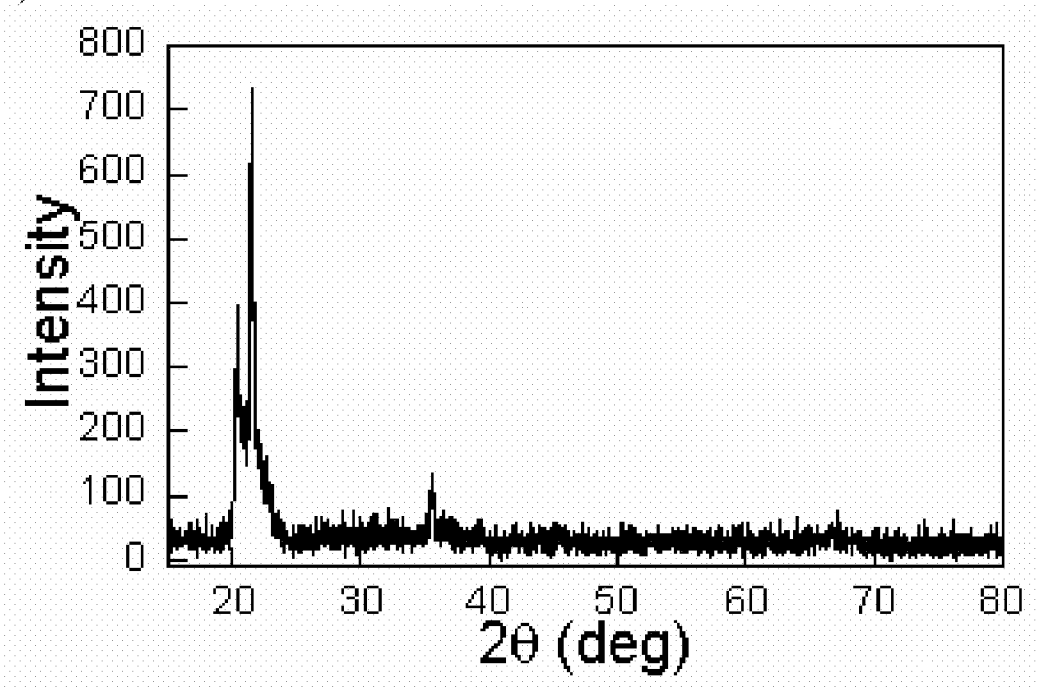

The solution mixture of Example 2 was refluxed. After various periods, some of the mixture was dried to a gel powder at 150° C. for 1 hour and then annealed at 1100° C. for 1 hour in air. As the refluxing time increased, the amount of amorphous aluminum phosphate increased. After 3.5 days of reflux, a substantially amorphous phase is formed. The $^{31}P$ NMR of the solution showed peaks near −5 ppm, indicating that the aluminum was complexed with the phosphorous (FIG. 12).

Example 4

119.28 g $Al(NO_3)_3.9H_2O$ was dissolved in 510 mL 1-butanol. In a separate beaker, an appropriate molar amount of phosphorous pentoxide was dissolved in 31 mL of 1-butanol. These two solutions were mixed together to form a 1.75/1 Al/P 1-butanol based solution. The solution was dried to a gel powder at 150° C. for 1 hour and then annealed to 1100° C. for 1 hour in air. A jet black powder resulted (black color due to the presence of residual carbon encapsulated in amorphous matrix), and the x-ray diffraction pattern indicated that the powder was substantially amorphous. TEM analysis revealed that the size of the carbon nanoinclusions was larger than those in powders derived from the solution of Example 1.

Example 5

Coupons of Inconel 718 were dip-coated with the solution of Example 1, and cured with an IR lamp for 10 min. The coupons were heat treated according to the schedule in Table 1 and examined under optical microscope after 20 cycles. It was noticed that there was no additional cracking of the coating compared to as-deposited coatings which showed some cracking near the edges and few cracks in other areas. This demonstrates that the thin nature of the deposited film of the inventive material is not subject to cracking from thermal stresses even though the thermal expansion mismatch between the substrate and the inventive material is significant.

TABLE 1

Thermal cycling profile from Example 5.

| Initial temperature (° C.) | Final temperature (° C.) | Time to reach final temperature (min) | Duration of hold at final temperature (min) |
|---|---|---|---|
| 20 | 468 | 35 | 50 |
| 468 | 100 | 75 | 0 |
| 100 | 538 | 35 | 30 |
| 538 | 100 | 75 | 0 |
| 100 | 607 | 40 | 30 |
| 607 | 100 | 85 | 0 |
| 100 | 760 | 52 | 1 |
| 760 | 20 | 95 | 0 |

Example 6

A piece of stainless steel was dip-coated into the solution mixture of Example 1. The coupon was dried with flowing air and heated with an IR lamp for a sufficient time to cure the film (remove all of the organics and nitrates) to form substantially inorganic material. The resulting coating was uniform and crack-free.

Example 7

Figure 13:
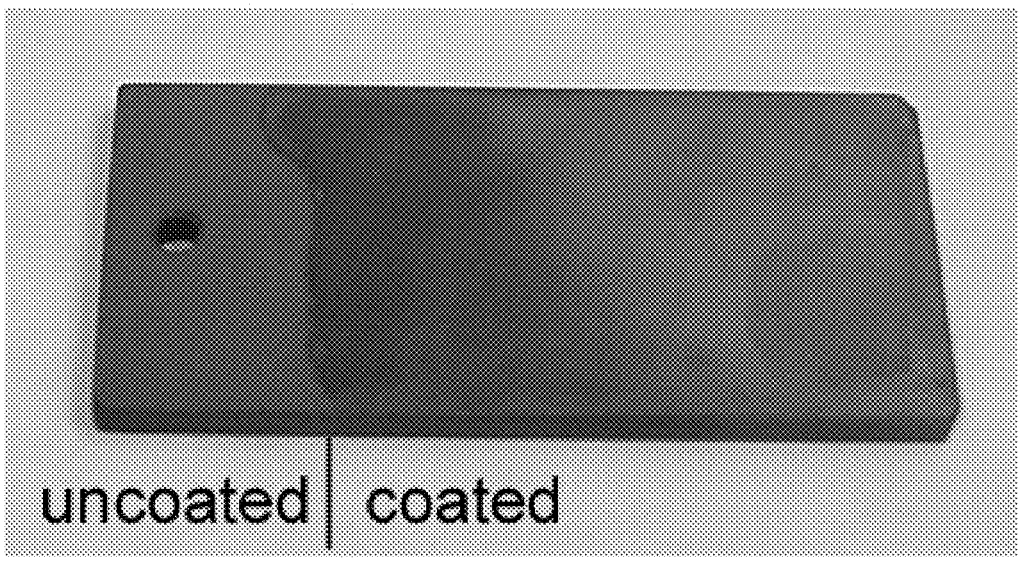
FIG. 13. A photograph showing the sample of example 9 after 900° C., 30 minutes anneal in air.

A stainless steel coupon was coated using the solution mixture of Example 1 by a roller. The roller was saturated with precursor solution and rolled quickly and firmly across most of the stainless steel coupon. The coupon is then heat treated with an IR lamp (as in Example 6) for sufficient time to remove all organics and nitrates. The coupon is heat treated to 900° C. for 30 minutes in air, and the coated portion of the substrate remains shiny, while the uncoated section appears dull from formation of substantially greater oxide scale (FIG. 13).

Example 8

2.2 grams of finely milled (sub-micron to few microns) amorphous aluminum phosphate powder (black in color) derived using processes in the aforementioned Examples was dispersed in 12 mL of ethanol and was added to 12 mL of the solution mixture from Example 1 to form a slurry for application of coatings. This slurry solution was used to coat a piece of type 304 stainless steel as in Example 7 that yielded a composite coating consisting of powder dispersed in the amorphous matrix derived from the solution portion of the slurry. The resulting coating had amorphous aluminum phosphate powder evenly distributed in a crack-free amorphous aluminum phosphate coating. The coating was substantially dark in appearance due to the presence of particles in the said composite coating.

Example 9

Figure 14:
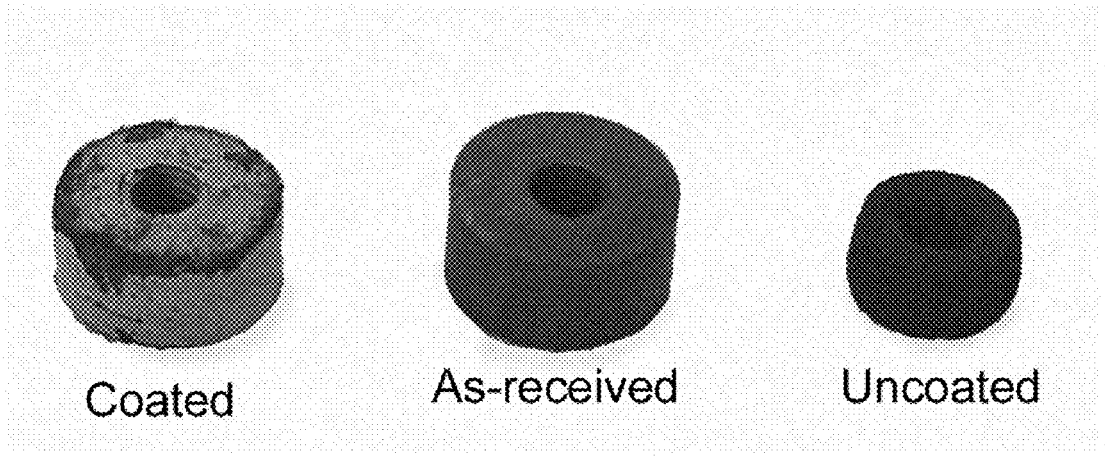
FIG. 14. Machined graphite pieces coated with amorphous aluminum phosphate (left) as-received (not heated) and uncoated (right). The samples pictured on the left and right were heated to 800° C., 2 hours in air.

As-machined graphite samples were coated with the inventive material and annealed, along with an uncoated piece, to 800° C. for 2 hours in air. The coated pieces retained their physical dimensions to a substantially greater extent than their uncoated counterparts as seen in FIG. 14 suggesting that the inventive material is effective in providing oxidation protection to graphite and carbon-based materials, including composites.

Example 10

Figure 15:
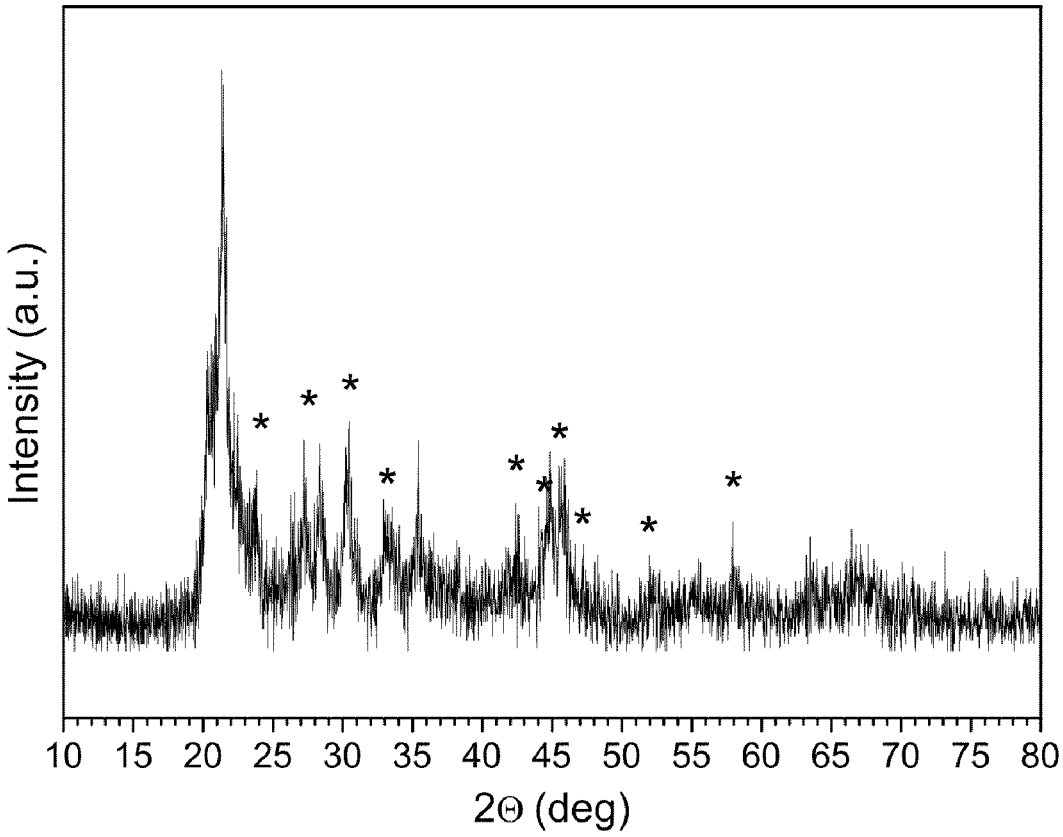
FIG. 15. Powder x-ray diffraction pattern of calcined material from example 10. The peaks near two-theta values of 20.5, 21.5 and 35 are from aluminum phosphate nanocrystals embedded in the amorphous phosphate matrix material. The other peaks correspond to $La_2P_4O_{13}$. Cu Kα radiation used.

19.47 g $P_2O_5$ was dissolved in 200 mL ethanol. In another container 180.68 g $Al(NO_3)_3.9H_2O$ was dissolved in 400 mL ethanol. In a third container, 16.32 g $La(NO_3)_3.6H_2O$ was dissolved in 100 mL ethanol. All three solutions were mixed together and stirred. A clear solution resulted. Some solution was dried at 150° C. in a convection oven and annealed to 1100° C. for 1 hour. Crystals of $La_2P_4O_{13}$ and a predominately amorphous aluminum phosphate were identified by x-ray diffraction (FIG. 15).

Example 11

Figure 16:
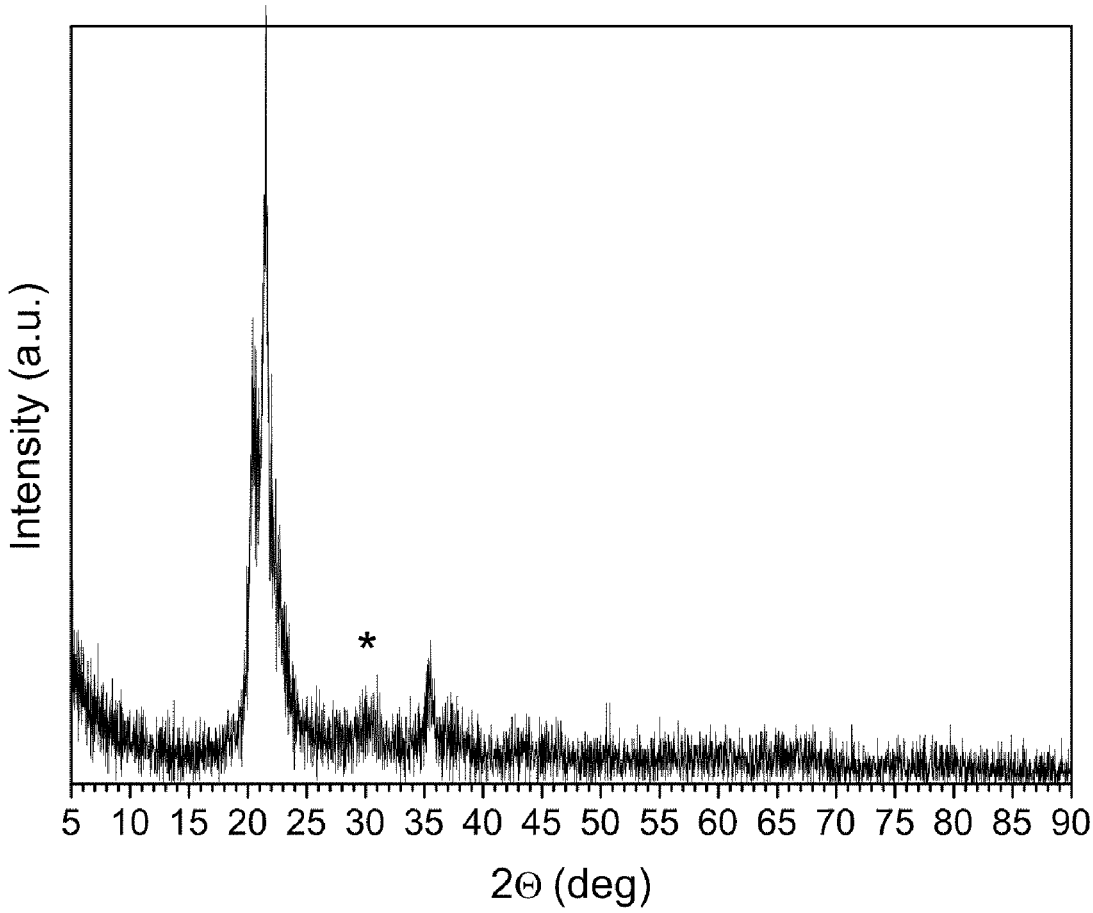
FIG. 16. Powder x-ray diffraction pattern of calcined material from example 11. The peaks near two-theta values of 20.5, 21.5 and 35 are from aluminum phosphate nanocrystals. The peak (labeled "*") near two-theta value of 30 is from tetragonal zirconia. Based on x-ray data, the size of the tetragonal zirconia nanocrystals are estimated to be about 7 nm after 1100° C., 0.5 h anneal, 26 nm after 1200° C., 50 h anneal, and 170 nm after 1400° C., 10 h anneal in air. Cu Kα radiation used.

Analogous to the preceding example, using similar methodology, a zirconium-containing solution can be made. 6.46 g $P_2O_5$ was dissolved in 70 mL ethanol. In another container 59.9 g $Al(NO_3)_3.9H_2O$ was dissolved in 140 mL ethanol. In a third container, 1.49 g $ZrO(NO_3)_3.xH2O$ was dissolved in 10 mL of ethanol. All three solutions were mixed together and stirred. Some solution was dried at 150° C. in a convection oven and annealed to 1000° C. for 1 hour. Crystals of tetragonal $ZrO_2$ and predominately amorphous aluminum phosphate were identified by x-ray diffraction (FIG. 16). The relative amount of zirconia nanocrystals depends to some degree on the storage time of the precursor.

Example 12

Figure 17:
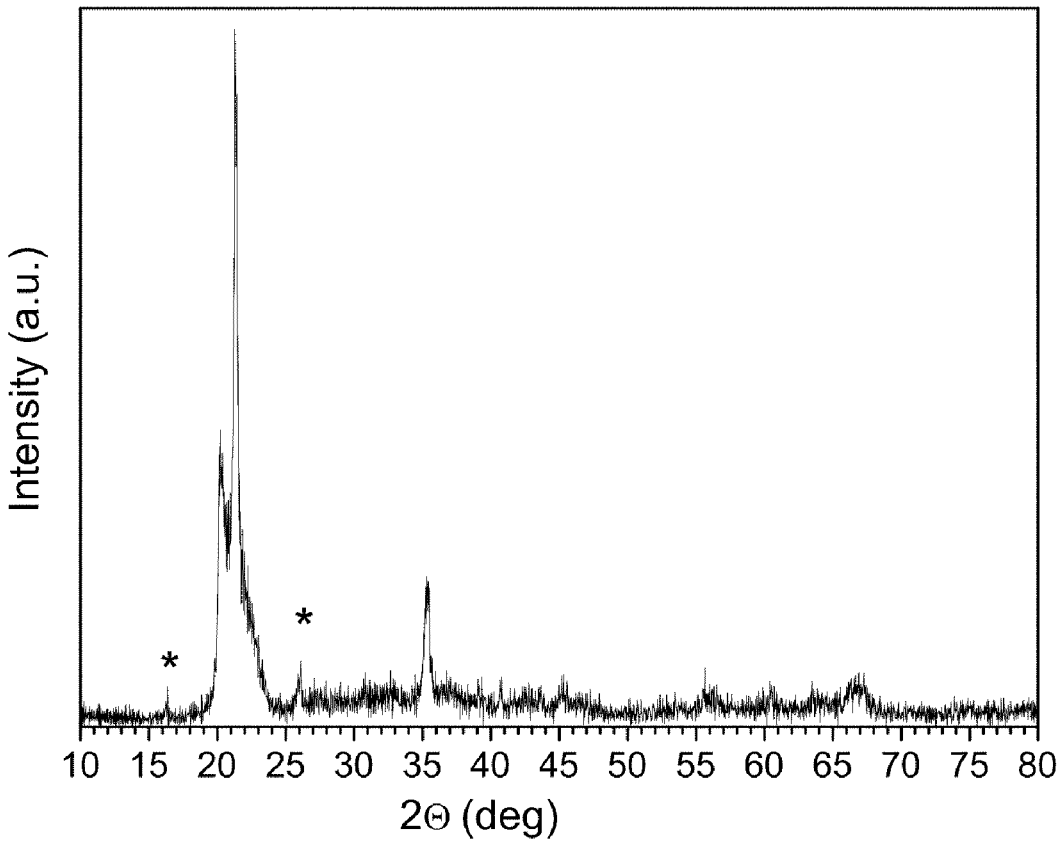
FIG. 17. X-ray diffraction pattern of calcined material from example 12. The peaks near two-theta values of 20.5, 21.5 and 35 are from aluminum phosphate nanocrystals. The peaks (labeled "*") near 16 and 26 are from mullite ($Al_6Si_2O_{13}$). The size of the mullite nanocrystals is 100 nm after 1200° C., 50 h heat treatment and 170 nm after 1400° C., 10 h heat treatment. Cu Kα radiation used.

Analogous to the preceding example, using similar methodology, a silicon-containing solution can be made 8.47 g $P_2O_5$ was dissolved in 90 mL ethanol. In another beaker, 78.6 g $Al(NO_3)_3.9H_2O$ was dissolved in 174 mL ethanol. In a third container, 1.7 g tetraethylorthosilane was dissolved in 15 mL ethanol. All three solutions were mixed together. Some of the solution was dried in a convection oven at 15° C. Some of this dried powder was annealed at 1400° C. for 10 hours. Crystals of mullite and predominately amorphous aluminum phosphate were identified by x-ray diffraction (FIG. 17).

Example 13

Figure 18:
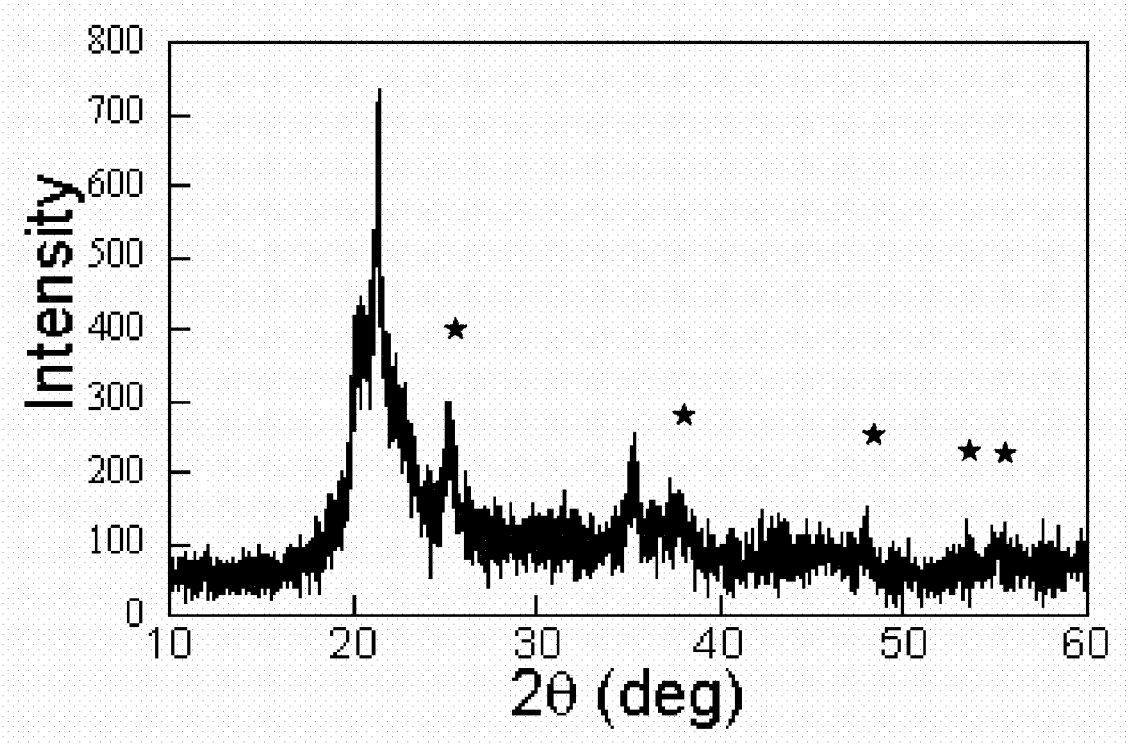
FIG. 18. X-ray diffraction pattern of calcined material from example 13. The peaks near 20.5, 21.5 and 35 are from aluminum phosphate nanocrystals. The peaks near 26 and 37 are from anatase titania nanocrystals. The titania nanocrystals are approximately 7 nm in diameter. Cu Kα radiation used.

Analogous to the preceding example, using similar methodology, a titanium-containing solution can be made 0.2 mL nitric acid was mixed with 9.8 4 mL deionized water. 2 mL titanium isopropoxide was added to this acidified water solution, and a white precipitate resulted. This mixture was added to 86 mL of the aluminum phosphate solution from example 1. This mixture was dried at 150° C. and annealed at 1000° C. for 1 hour. X-ray diffraction indicated the presence of titanium oxide (anatase) and predominately amorphous aluminum phosphate (FIG. 18).

Example 14

The solution of Example 1 is dried and heat treated to 1100° C. for 1 hour. The powder is milled to 10-20 microns in diameter. The resulting powder is jet black in color and the x-ray diffraction pattern confirms that the powder is substantially amorphous.

Example 15

Figure 19:
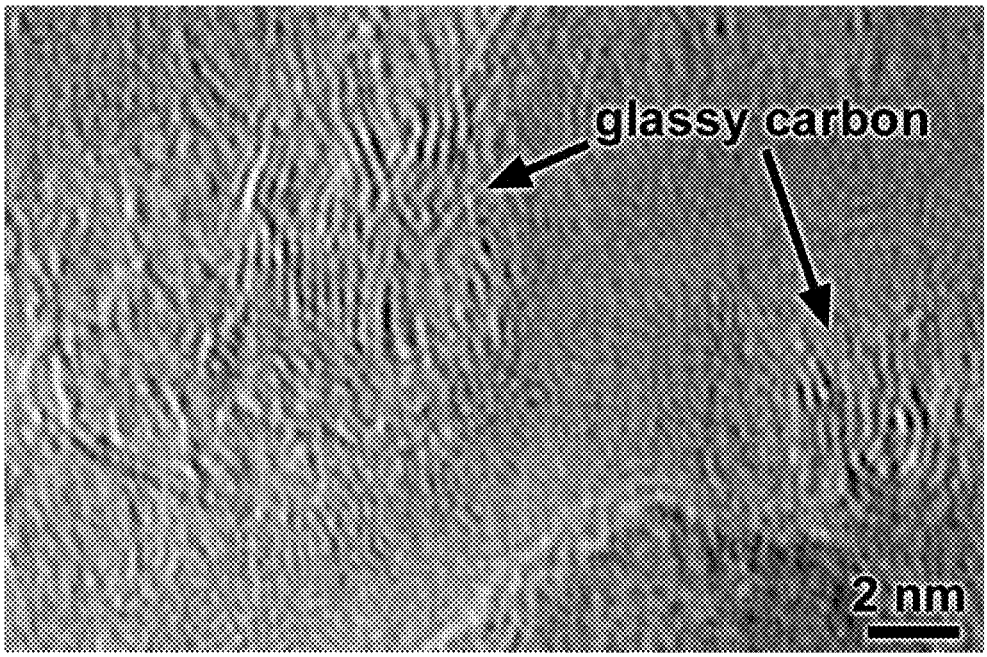
FIG. 19. Transmission electron micrograph showing nanoinclusions of glassy carbon in powders of a compound, composition and/or material of this invention.

The powder of Example 4 is examined in the TEM. Transmission electron microscopy has shown nanoinclusions of glassy carbon embedded in the amorphous matrix of the inventive material. These inclusions are about 2-4 nm by 10-40 nm in size (FIG. 19). The inclusions are typical in appearance of glassy carbon and EDS evidence has shown that these particles primarily contain carbon.

Example 16

The powder of Example 14 is dispersed in the solution mixture of Example 1. This slurry is painted on an alumina substrate. This coating is dried in flowing air until the solvent has evaporated and then heat cured above 500° C. The room temperature total hemispherical emissivity of the coating, as measured from 2-20 μm, is 0.917.

Example 17

The coating of Example 16 is heat treated in air at 815° C. for 100 h. The room temperature total hemispherical emissivity of the coating, as measured from 2-20 μm, is 0.908 suggesting that substantial portion of the nanoinclusions of carbon did not oxidize and was well protected by the substantially pore-free and dense matrix of the inventive material.

Example 18

The coating of Example 16 is heat treated in air to 1100° C. for 24 h. The room temperature total hemispherical emissivity of the coating, as measured from 2-20 μm, is 0.902. As in Example 17, protection of carbon is demonstrated even at these elevated temperatures.

Example 19

Solution mixture of Example 1 was modified via addition of an organic component to enable development of thicker films that are crack-free. A piece of 1018 carbon steel was coated with the aforementioned solution that yielded a relatively thicker coating (>1 micron average) which was substantially crack-free. The amount of organic additive can be varied to obtain a range of thicknesses for the film deposited. The coated 1018 coupon was subjected to salt fog chamber, per conditions specified in ASTM B117 test along with an uncoated coupon for four days. The coated coupon was substantially corrosion-free while the coated coupon was almost fully corroded. This demonstrates the substantially crack and pin-hole free nature of thicker coatings of the inventive material.

Example 20

Using the process described in Example 19, a completely inorganic coating that is substantially opaque and dark in appearance can be developed on metallic and other substrates. A piece of stainless steel was coated to yield a black coating. The coating is substantially crack or pore-free, hard and abrasion resistant and may have excellent weathering resistance as compared to conventional black paints. Excellent adhesion is also promoted as described in the specifications of the patent application.

Example 21

An alcoholic solution containing silver ions was added to the solution mixture from Example 1. This solution was used to coat a soda-lime glass slide. The applied coating was dried in flowing air to remove the solvent and cured to form a substantially transparent inorganic coating.

Example 22

Figure 20:
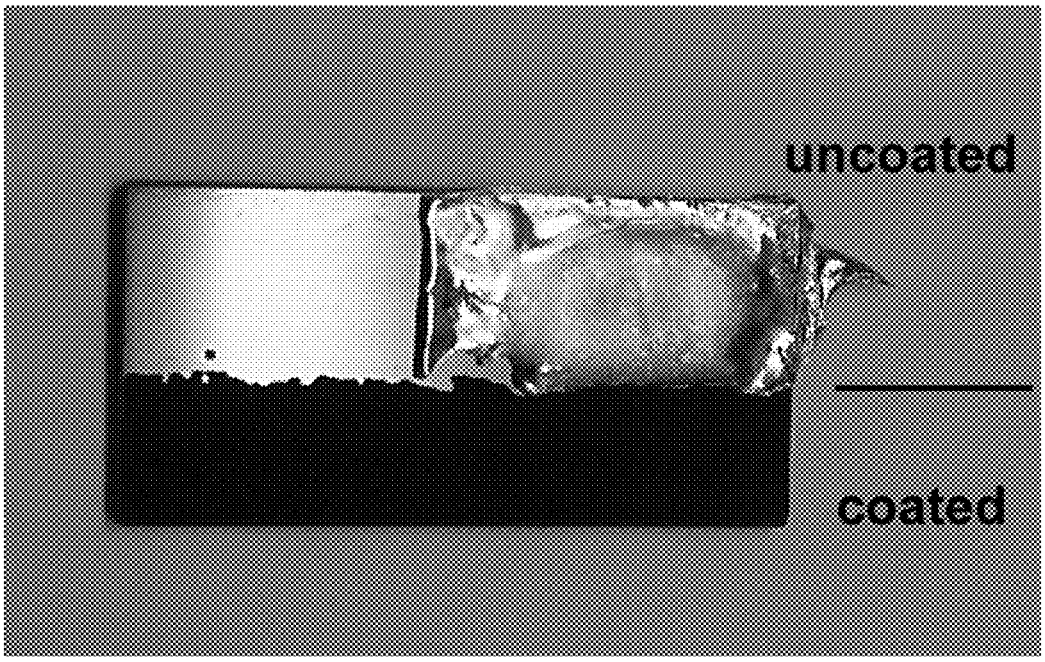
FIG. 20. Photograph of half-coated stainless steel coupon after immersion in molten aluminum (~750° C.), showing non-wetting character. The dashed line shows the line of immersion in the molten aluminum.

A slurry coating as described in Example 16 was applied to a portion of a stainless steel coupon. The coated sample was immersed in pure molten aluminum at 760° C. and retracted. No noticeable wetting of aluminum was observed on the coated portion of the coupon as compared to complete coverage of the uncoated portion immersed in molten aluminum, thus demonstrating the chemical stability and compatibility with molten aluminum and excellent non-wetting characteristics. (See FIG. 20.)

Example 23

Figure 21:
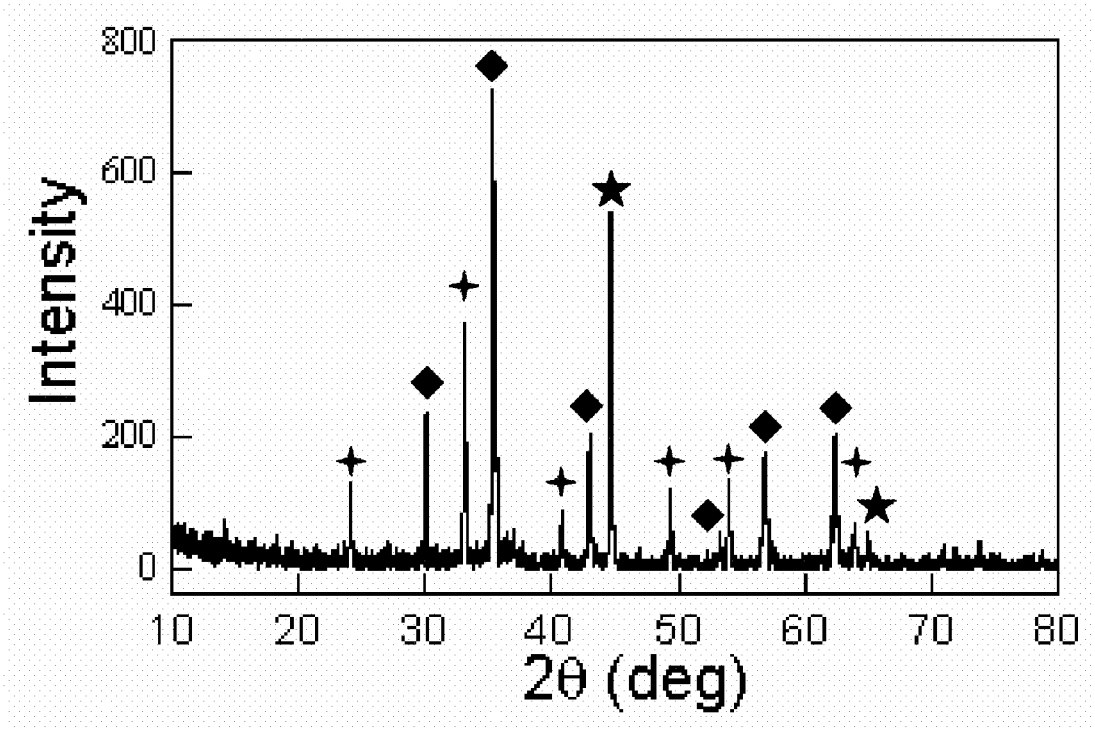
FIG. 21. X-ray diffraction patterns of 1018 carbon steel heat-treated to 500° C. for 30 minutes. (A) Coated with an inventive aluminophosphate; and (B) uncoated. The (*) indicates the substrate; the (♦) indicates $Fe_3O_4$; and the (+) indicates $Fe_2O_3$.
Figure 21:
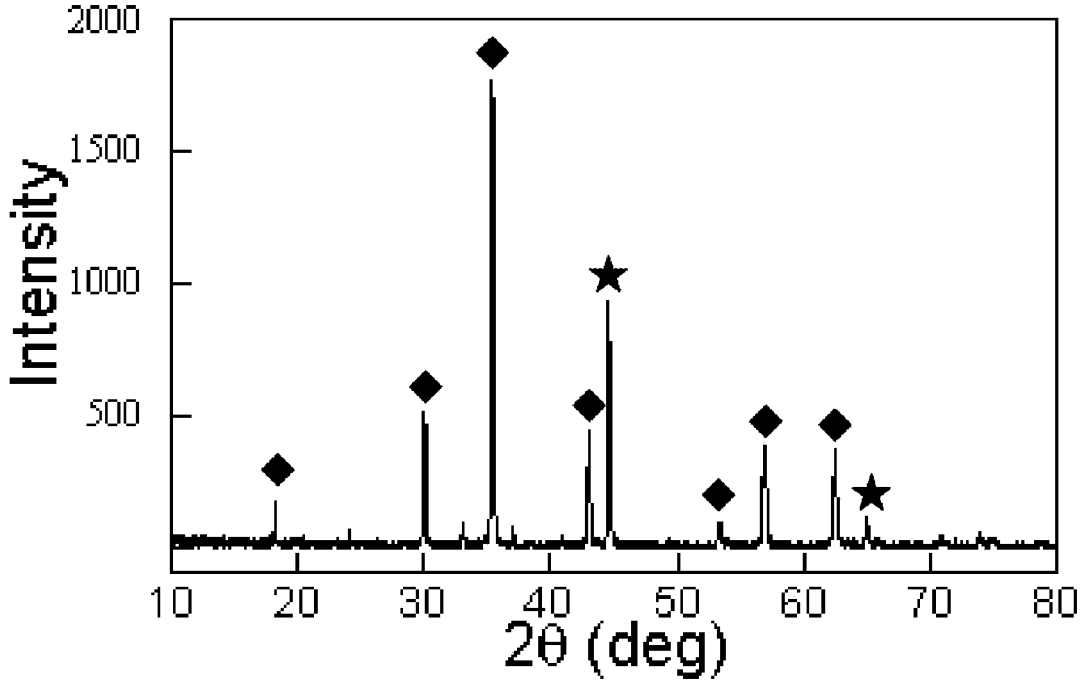

A piece of 1018 carbon steel is dip-coated using the solution mixture of Example 1. This coating is dried in flowing air until the solvent has evaporated and then heat treated at 500° C. for 30 minutes in air. X-ray diffraction of the surface of the sample showed that an oxide scale of predominately $Fe_2O_3$ had grown on the surface, with small amounts of $Fe_3O_4$. An uncoated piece of 1018 steel was also heat treated at 500° C. for 30 minutes. X-ray diffraction of the surface showed predominately $Fe_3O_4$ formation, with a very slight amount of $Fe_2O_3$ (FIG. 21). $Fe_2O_3$ is a substantially more protective oxide scale than $Fe_3O_4$. This also demonstrates the ability of the film of the inventive material to substantially alter the chemistry of oxide scale growth of metallic substrates.

Example 24

Figure 22:
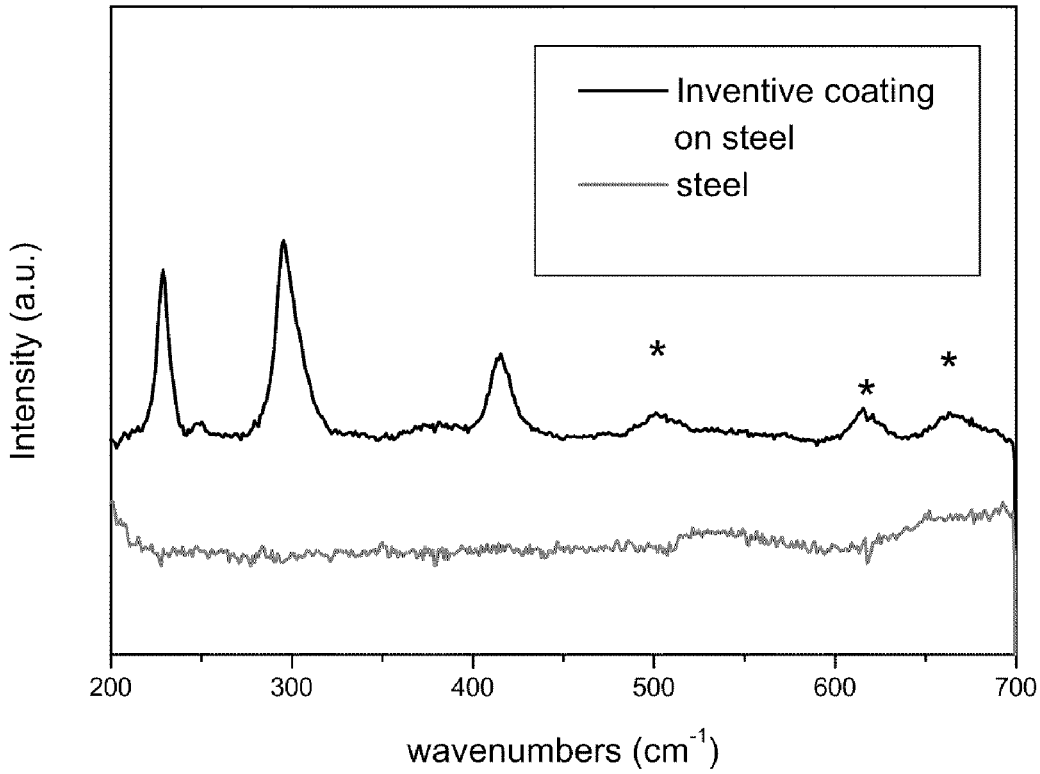
FIG. 22. Raman spectrum of a coating of an inventive aluminophosphate material on stainless steel. The labeled (*) peaks are from an adhesion layer between the coating and the substrate.

A piece of stainless steel is partially dip-coated in solution mixture of Example 1 and cured above 500° C. for few minutes in air. Raman spectra of both the coated and uncoated portions of the coupon were taken. In the spectrum of the coated part of the sample, three peaks are visible which do not correspond to the uncoated sample or crystalline aluminum phosphate or amorphous aluminum phosphate obtained using methods prescribed in this invention, thus suggesting that the peaks correspond to material formed ("interface layer") near the interface between the coating and the substrate. Although the exact chemistry or nature of the interface layer is not known, it is believed that this helps in improving the adhesion of the coating. The nature of the interface layer may vary depending on the chemistry of the substrate composition and the heat treatment conducted during and after the deposition of the coating (FIG. 22).

Example 25

Figure 23:
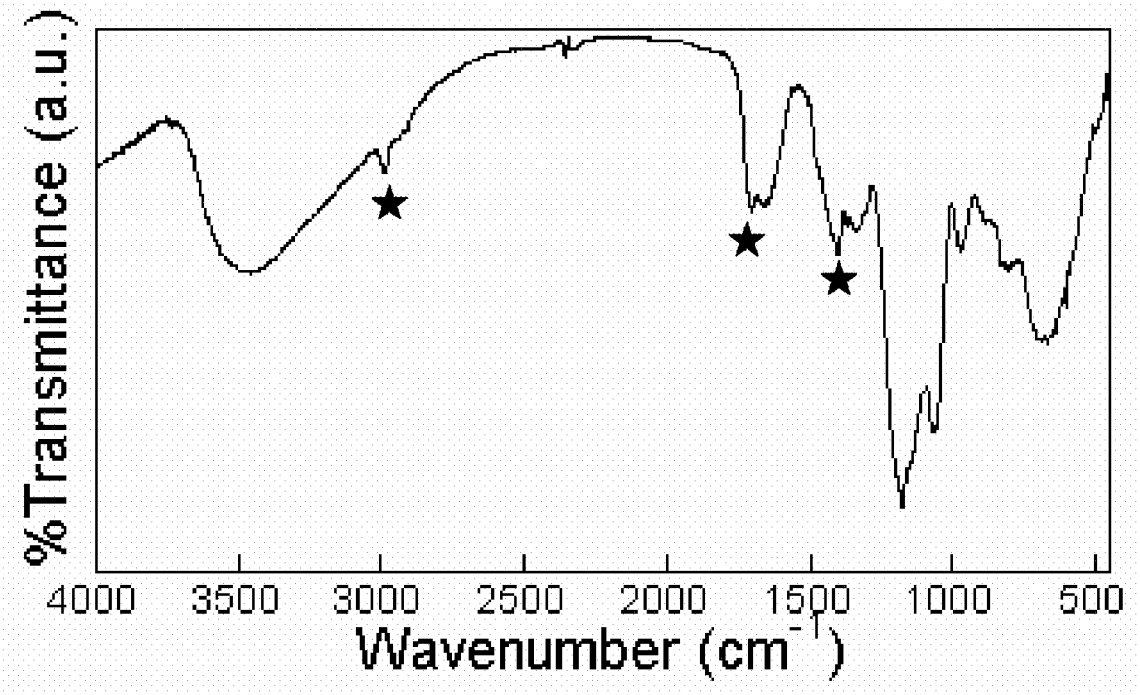
FIG. 23. Grazing angle FTIR spectrum of stainless steel coated with a thin film of an inventive aluminophosphate compound, composition and/or material after exposure to the ambient. The labeled (*) peaks indicate organics absorbed on the coating surface.

A piece of stainless steel is dip-coated using the solution mixture of Example 1 and cured using a procedure prescribed in Example 24. This coated specimen is exposed to the ambient for a period of days. FTIR spectra collected from the surface shows the presence of organic species w (FIG. 23). The bonding of the organic appears to be robust and helps in further lowering the surface energy and yields a substantially more non-wetting surface.

Example 26

The sample of Example 20 is immersed and retracted from molten aluminum at 760° C. Significant portion of the coated portion appeared to be completely non-wetting to molten aluminum.

Example 27

A piece of steel was partially coated with the solution mixture of Example 1. The coupon was dried with flowing air and heated at 500° C. for a sufficient time to cure the film (remove all of the organics and nitrates) to form substantially inorganic material. The surface energy of the coated sample, as well as the uncoated, heat treated sample was measured. The surface energy of the coated material was 31.89 $mJ/m^2$.

We claim:

1. A method to protect a metallic substrate from coking or carburization comprising applying an aluminum salt and phosphorous pentoxide or soluble phosphate ester solution to the substrate surface, heating the applied solution for a time and temperature sufficient to form a predominantly amorphous and substantially pore-free aluminophosphate film onto the metallic substrate, in which the metallic substrate is a cracking tube or reactor.

2. A method of claim 1 in which the metal substrate contains iron, aluminum, magnesium, zinc, silver, or copper or alloys of steel, titanium, nickel, or copper.

3. A method of claim 1 in which the metal substrate is a steel alloy.

4. A method of claim 1 in which the solution applied to the substrate surface has been heated at a temperature of at least 300° C.

5. A method of claim 1 in which the tube or reactor cracks hydrocarbons.

6. A method of claim 1 in which the aluminophosphate film is a protective coating in oxidizing or reducing environments.

7. A method to protect a metallic substrate from coking or carburization comprising applying an aluminum salt and phosphorous pentoxide or soluble phosphate ester solution to the substrate surface, heating the applied solution for a time and temperature sufficient to form a predominantly amorphous and substantially pore-free aluminophosphate film onto the metallic substrate, in which the metallic substrate is an ethylene cracking tube.

8. A method of claim 7 in which the metal substrate contains iron, aluminum, magnesium, zinc, silver, or copper or alloys of steel, titanium, nickel, or copper.

9. A method of claim 7 in which the metal substrate is a steel alloy.

10. A method of claim 7 in which the solution applied to the substrate surface has been heated at a temperature of at least 300° C.

11. A method of claim 7 in which the aluminophosphate film is a protective coating in oxidizing or reducing environments.

12. A method to protect a metallic substrate from coking or carburization comprising providing a precursor to an aluminophosphate compound, said precursor comprising an aluminum salt and a phosphorous pentoxide or soluble phosphate ester in a fluid medium; applying said medium to a substrate; and heating said applied medium for a time and at a temperature sufficient to provide a substantially amorphous and substantially non-porous aluminophosphate compound on said substrate, in which the metallic substrate is a cracking tube or reactor.

13. A method of claim 12 in which the tube or reactor cracks hydrocarbons.

14. A method of claim 13 wherein said fluid medium is an alcoholic solution of said aluminum salt and a phosphorous pentoxide or soluble phosphate ester.

15. A method of claim 14 wherein said application is selected from dip-coating, flow coating, and spraying.

16. A method of claim 13 in which the metallic substrate is an ethylene cracking tube.

* * * * *

UNITED STATES PATENT AND TRADEMARK OFFICE

CERTIFICATE OF CORRECTION

PATENT NO. : 8,124,184 B2
APPLICATION NO. : 12/724052
DATED : February 28, 2012
INVENTOR(S) : Sankar Sambasivan and Kimberly A. Steiner It is certified that error appears in the above-identified patent and that said Letters Patent is hereby corrected as shown below:

Column 2, line 30:
"urethane resin to a metal by the formation of $P\text{-}O^{-}M^{2+}$ ionic" should read --urethane resin to a metal by the formation of $P\text{-}O^{-}/M^{2+}$ ionic--.

Column 11, line 28:
"above about 140 C) in a broad range of benign to harsh" should read --above about 1400 C) in a broad range of benign to harsh--.

Column 16, line 37
"action of $H_{25}$ on Ag)." should read --action of $H_2S$ on Ag).--.

Column 25, line 30
"264 g of $Al(NO_3)_3.9H_2O$ is dissolved in 300 mL ethanol. In" should read --264 g of $Al(NO_3)_3{\cdot}9H_2O$ is dissolved in 300 mL ethanol. In--.

Column 25, line 42
"$_3.9H_2O$ in 181 mL of ethanol. After stirring for 30 min, the" should read --$_3{\cdot}9H_2O$ in 181 mL of ethanol. After stirring for 30 min, the--.

Column 25, line 66
"119.28 g $Al(NO_3)_3.9H_2O$ was dissolved in 510 mL 1-bu-" should read --119.28 g $Al(NO_3)_3{\cdot}9H_2O$ was dissolved in 510 mL 1-bu- --.

Column 27, line 27
"container 180.68 g $Al(NO_3)_3.9H_2O$ was dissolved in 400 mL" should read --container 180.68 g $Al(NO_3)_3{\cdot}9H_2O$ was dissolved in 400 mL--.

Signed and Sealed this
Twenty-fourth Day of April, 2012

David J. Kappos

David J. Kappos
*Director of the United States Patent and Trademark Office*

Column 27, line 28
"ethanol. In a third container, 16.32 g $La(NO_3)_3.6H_2O$ was" should read --ethanol. In a third container, 16.32 g $La(NO_3)_3 \cdot 6H_2O$ was--.

Column 27, line 41
"59.9 g $Al(NO_3)_3.9H_2O$ was dissolved in 140 mL ethanol. In a" should read --59.9 g $Al(NO_3)_3 \cdot 9H_2O$ was dissolved in 140 mL ethanol. In a--.

Column 27, line 56
"g $Al(NO_3)_3.9H_2O$ was dissolved in 174 mL ethanol. In a third" should read --g $Al(NO_3)_3 \cdot 9H_2O$ was dissolved in 174 mL ethanol. In a third--.

Column 27, line 59
"solution was dried in a convection oven at 15° C. Some of this" should read --solution was dried in a convection oven at 150° C. Some of this--.